US006145727A

United States Patent [19]

Mukoyama et al.

[11] Patent Number: 6,145,727

[45] Date of Patent: Nov. 14, 2000

[54] PNEUMATIC TOOL

[75] Inventors: Kenji Mukoyama; Yukiyasu Okouchi; Masaki Sakuragi; Junichi Iwakami, all of Anjo, Japan

[73] Assignee: Makita Corporation, Anjo, Japan

[21] Appl. No.: 09/309,888

[22] Filed: May 11, 1999

[30] Foreign Application Priority Data

May 11, 1998 [JP] Japan ..... 10-127778

[51] Int. Cl.[7] ..... B25C 1/04

[52] U.S. Cl. ..... 227/130; 227/8; 227/142

[58] Field of Search ..... 227/130, 8, 113, 227/142, 119

[56] References Cited

U.S. PATENT DOCUMENTS

| | | | |
|---|---|---|---|
| 3,438,449 | 4/1969 | Smith . | |
| 5,131,579 | 7/1992 | Okushima et al. | 227/8 |
| 5,441,192 | 8/1995 | Sugita et al. | 227/130 |
| 5,495,973 | 3/1996 | Ishizawa et al. | 227/113 |
| 5,671,880 | 9/1997 | Ronconi | 227/130 |
| 5,715,982 | 2/1998 | Adachi | 227/142 |

FOREIGN PATENT DOCUMENTS

| | | |
|---|---|---|
| 4 812913 | 4/1973 | Japan . |
| 6-5093 | 2/1994 | Japan . |
| 7-308870 | 11/1995 | Japan . |

*Primary Examiner*—Scott A. Smith

*Attorney, Agent, or Firm*—Dennison, Scheiner, Schultz & Wakeman

[57] ABSTRACT

A pneumatic tool, such as a nailer, includes a housing, a cylinder disposed within the housing, and a piston slidably movable within the cylinder. The piston has a driver for driving fasteners, such as nails. An upper piston chamber and a lower piston chamber are defined within the cylinder on an upper side and a lower side of the piston, respectively. A control device is provided for controlling the supply of compressed air from a compressed air supply device to the upper piston chamber and to the lower piston chamber to drive the fasteners into a workpiece. The control device includes a variable pressure chamber and a valve. The variable pressure chamber is always connected to the compressed air supply device. The valve is operable to connect and disconnect the variable pressure chamber and the lower piston chamber in response to the position of the piston relative to the cylinder. A device is provided to maintain a predetermined volume in the variable pressure chamber, irrespective of the operation of the control device.

12 Claims, 18 Drawing Sheets

PNEUMATIC TOOL

BACKGROUND OF THE INVENTION

1. Field of the invention

The present invention relates to a pneumatic tool, such as a pneumatic nailer that has a driver for driving fasteners.

2. Description of the Related Art

U.S. Pat. No. 3,438,449 teaches a pneumatic nailer that has a driver for driving nails. The nail is set in the nailer in a position adjacent a front end of a driver and is then driven into a workpiece with a multiple of impact blows by the driver. FIG. 4 of this U.S. patent has been incorporated into the drawings of this application as FIG. 19. FIG. 19 shows a nailer 100 in a non-operative position, in which compressed air is supplied from a pressurized air source (not shown) to a pressure accumulation chamber 101 via an air hose 107, so that the compressed air is accumulated within the presssure accumulation chamber 101. The pressure accumulation chamber 101 communicates with a variable pressure chamber 103 via a port 102. The variable pressure chamber 103 is defined between a lower end of a sleeve valve 104 and a top surface of a flange 105*a* of a cylinder 105. In the non-operative position shown in FIG. 19, ports 108 connecting the variable pressure chamber 103 to a lower piston chamber 111 are positioned between an upper seal ring 110*a* and a lower seal ring 110*b*, so that the variable pressure chamber 103 is disconnected from the lower piston chamber 111.

On the other hand, because of the pressure of the compressed air accumulated within the variable pressure chamber 103, the sleeve valve 104 is lifted upward. As a result, the upper end of the sleeve valve 104 is pressed against a seal member 112. Further, an upper piston chamber 113 is disconnected from the pressure accumulation chamber 101. Here, the upper piston chamber 113 opens to the outside via a central opening 115*a* of a cylinder cap 115 and exhausting slots 151 formed in a housing 150. The cylinder cap 115 is secured to the upper end of the cylinder 105.

The lower piston chamber 111 opens to the outside via a port that is formed by a flat surface portion 120*a* of a driver 120, which driver serves to drive nails.

In the non-operative position shown in FIG. 19, an operator sets a nail (not shown) in a position adjacent the front end of the driver 120. Then, the operator presses the nailer 100 downward against a workpiece, so that the piston 110 with the driver 120 moves upward relative to the cylinder 105. When the lower seal ring 110*b* of the piston 110 has moved to a position above the ports 108, the lower piston chamber 111 communicates with the variable pressure chamber 103, so that the compressed air is supplied to the lower piston chamber 111. At the same time, the port previously formed by the flat surface portion 120*a* of the driver 120 is closed by a bumper 121, so that the lower piston chamber 111 is disconnected from the outside.

With the compressed air supplied to the lower piston chamber 111, the piston 110 with the driver 120 abruptly moves upward. Then, a protrusion 110*c* on the upper surface of the piston 110 moves to engage the central opening 115*a*, so that the upper piston chamber 113 is disconnected from the outside. As the piston 110 moves upward, the air within the upper piston chamber 113 is compressed.

The piston 110 abuts the cylinder cap 115 when it moves further upward to compress the air within the upper piston chamber 113 as described above. The piston 110 moves further upward with abutment to the cylinder cap 115 so as to also move the cylinder cap 115 upward. As a result, the cylinder 105 moves upward. As the cylinder cap 115 thus moves upward, the central opening 115*a* receives a protrusion 152 formed on an inner wall of the upper portion of the housing 150, so that the upper piston chamber 113 is substantially disconnected from the atmosphere.

On the other hand, as the cylinder 105 with the cylinder cap 115 moves upward, the lower piston chamber 111 opens to the outside via openings 114. At the same time that the lower piston chamber 111 opens to the atmosphere, the variable pressure chamber 103 also opens to the outside via the ports 108. Although the ports 108 are plural in number and are circumferentially spaced from each other, the port 102 that connects the variable pressure chamber 103 to the accumulation chamber 101 is one in number. Therefore, the sectional area of the whole ports 108 is substantially greater than the sectional area of the port 102. As a result, the pressure within the variable pressure chamber 103 abruptly drops.

The pressure within the upper piston chamber 113 increases while the pressure within the variable pressure chamber 103 drops as described above. Therefore, the increased pressure applied to the upper end of the sleeve valve 104 forces the sleeve valve 104 to move downward. As the sleeve valve 104 moves downward, the lower end of the sleeve valve 104 is pressed against the upper surface of the flange 105*a* of the cylinder 105. Also, as the sleeve valve 104 moves downward, the upper end of the sleeve valve 104 moves apart from the seal member 112. As a result, the upper piston chamber 113 communicates with the accumulation chamber 101. Therefore, the compressed air is supplied to the upper piston chamber 113 to move the piston 110 downward.

During the supply of the compressed air to the upper piston chamber 113, the cylinder 105 with the cylinder cap 115 further moves upward. On the other hand, the driver 120 moves downward with the piston 110 to apply an impact blow to the nail.

Because the lower end of the sleeve valve 104 abuts the flange 105*a* of the cylinder 105, the sleeve valve 104 moves upward with the cylinder 105. Therefore, the upper end of the sleeve valve 104 subsequently abuts the seal member 112 to disconnect the upper piston chamber 113 from the accumulation chamber 101.

When the piston 110 reaches the lower stroke end, the lower seal ring 110*b* returns to a position below the ports 108, so that the compressed air is supplied to the variable pressure chamber 103 from the accumulation chamber 101 via the port 102.

On the other hand, as the piston 110 moves downward, the protrusion 110*c* is removed from the central opening 11 Sa of the cylinder cap 115, so that the upper piston chamber 113 opens to the outside via the central opening 115*a* and the opening 151. As a result, the pressure within the upper piston chamber 113 is lowered. Although, at this stage, the protrusion 152 of the housing 150 engages the central opening 115*a*, the central hole 150 may not be completely closed by the protrusion 152. Therefore, the compressed air within the upper piston chamber 113 may be gradually exhausted to the outside via the central opening 115*a* and the opening 151.

The upper piston chamber 113 thus opens to the outside while the variable pressure chamber 103 is disconnected from the lower piston chamber 111 to cause increase of the pressure therewithin. The increased pressure within the variable pressure chamber 103 is applied to the flange 105*a* to lower the cylinder 105. Consequently, one cycle of the operation of the nailer 100 is completed.

The above operation is again performed as the operator again presses the nailer 100 against the workpiece, so that the nail can be driven into a workpiece with a multiple of impact blows by the driver 120.

However, as shown in FIG. 19, the nailer 100 of the U.S. patent has a short stroke length in comparison with the diameter of the housing 150. Therefore, the nailer 100 cannot be effectively used at a narrow workplace. The housing 150 may have a long and narrow configuration if the stroke length is long. However, the following problems may be produced if such a long stroke length has been incorporated into the nailer 100:

As described above, when the variable pressure chamber 103 opens to the outside while the pressure within the upper piston chamber 113 increases, the sleeve valve 104 moves downward. The lower end of the sleeve valve 104 then abuts the flange 105*a* of the cylinder 105. The compressed air is supplied to the upper piston chamber 113, so that the sleeve valve 104 is moved upward together with the cylinder 105. The sleeve valve 104 subsequently abuts the seal member 112 to disconnect the upper piston chamber 113 from the accumulation chamber 101.

If the stroke length of the piston 110 is long, the sleeve valve 104 may move upward before the piston 110 reaches the lower stroke end. As a result, the compressed air may not be sufficiently supplied to the upper piston chamber 113. The impact force applicable to the nail by the driver 120 may therefore be weakened. In addition, the operation of the driver 120 becomes unstable.

SUMMARY OF THE INVENTION

It is, accordingly, an object of the invention to provide an improved pneumatic tool. Preferably, a pneumatic tool, such as a nailer, includes a housing, a cylinder disposed within the housing, and a piston slidably movable within the cylinder. The piston has a driver for driving fasteners, such as nails. An upper piston chamber and a lower piston chamber are defined within the cylinder on an upper side and a lower side of the piston, respectively. A control device is provided for controlling the supply of compressed air from a compressed air supply device to the upper piston chamber and to the lower piston chamber to drive the fastener into a workpiece. The control device preferably includes a variable pressure chamber and a valve. The variable pressure chamber is always connected to the compressed air supply device. The valve is operable to connect and disconnect the variable pressure chamber and the lower piston chamber in response to the position of the piston relative to the cylinder. A device is provided to maintain a predetermined volume in the variable pressure chamber, irrespective of the operation of the control device.

The control device may include a sleeve valve for controlling the supply of compressed air from the compressed air supply device to the upper piston chamber, such that the variable pressure chamber is preferably defined between the cylinder and the sleeve valve.

Preferably, the cylinder and the sleeve valve are movable relative to the housing independently of each other, so that the volume of the variable piston chamber varies with changes in position of the sleeve valve relative to the cylinder.

Preferably, the device for maintaining the volume of the variable pressure chamber comprises a stopper device for limiting the lower stroke end of the sleeve valve.

The stopper device may include a seal ring mounted on the sleeve valve and a stopper block mounted within the housing. The stopper block may have an abutting surface, to which the seal ring abuts.

Other objects, features and advantages of the present invention will be readily understood after reading the following detailed description together with the accompanying drawings and the claims.

BRIEF DESCRIPTION OF THE DRAWINGS

FIGS. 14(C) and 14(B) are explanatory views showing the operations of a nail guide having an inclined lower end according to the nailer of the representative embodiment;

DETAILED DESCRIPTION OF THE INVENTION

Figure 1:
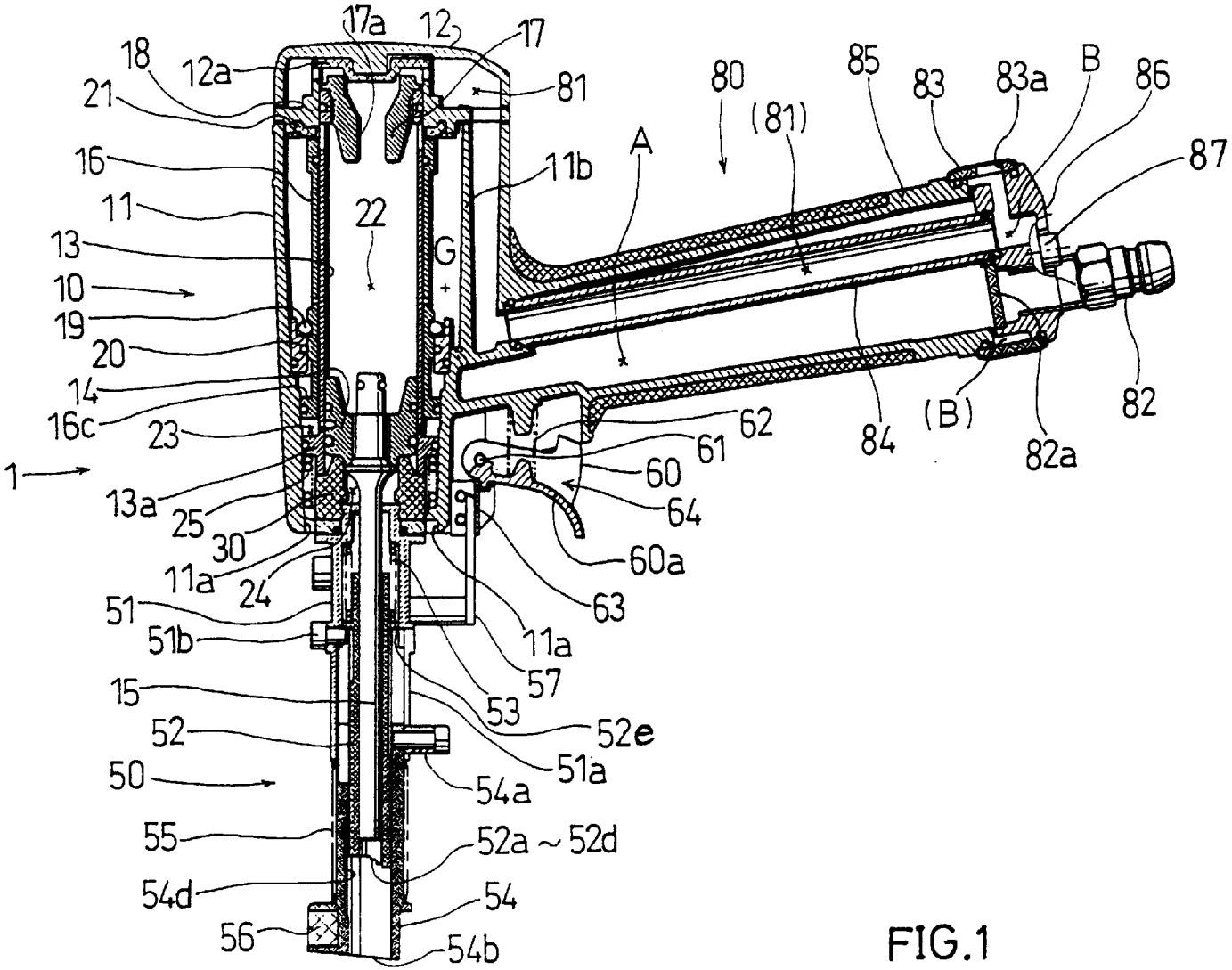
FIG. 1 is a vertical sectional view of a representative embodiment of a nailer according to the present invention.

Preferably, a pneumatic tool, such as a nailer, includes a housing, a cylinder disposed within the housing, and a piston slidably movable within the cylinder. The piston has a driver for driving fasteners, such as nails. An upper piston chamber and a lower piston chamber are defined within the cylinder on an upper side and a lower side of the piston, respectively. A control device is provided for controlling the supply of compressed air from a compressed air supply device to the upper piston chamber and to the lower piston chamber to drive the fastener into a workpiece. The control device preferably includes a variable pressure chamber and a valve. The variable pressure chamber is always connected to the compressed air supply device. The valve is operable to connect and disconnect the variable pressure chamber and the lower piston chamber in response to the position of the piston relative to the cylinder. A device is provided to maintain a predetermined volume in the variable pressure chamber, irrespective of the operation of the control device.

Because the variable pressure chamber may have a predetermined volume, the variable pressure chamber can always reliably perform its function. Therefore, the valve can reliably operate to supply a sufficient amount of compressed air to the upper piston chamber to move the pistol.

The control device may include a sleeve valve for controlling the supply of compressed air from the compressed air supply device to the upper piston chamber, such that the variable pressure chamber is preferably defined between the cylinder and the sleeve valve.

Preferably, the cylinder and the sleeve valve are movable relative to the housing independently of each other, so that the volume of the variable piston chamber varies with changes in position of the sleeve valve relative to the cylinder.

Preferably, the device for maintaining the volume of the variable pressure chamber comprises a stopper device for limiting the lower stroke end of the sleeve valve.

In a representative embodiment, the stopper device includes a seal ring mounted on the sleeve valve and a stopper block mounted within the housing. The stopper block may have an abutting surface, to which the seal ring abuts.

Preferably, the control device further includes a second valve for connecting and disconnecting between the upper piston chamber and the outside of the tool. The second valve may include a cylinder cap and a protrusion. The cylinder cap may be mounted on an upper end of the cylinder and may have an exhaust hole formed therein for communication with the outside. The protrusion may be formed on the piston and may have a seal ring mounted thereon. The protrusion may extend into the upper piston chamber, so that the exhaust hole can be closed by the seal ring of the protrusion when the piston with the protrusion moves upward.

Because the exhaust hole can be closed by the seal ring that is mounted on the piston, the upper piston chamber can reliably be closed from the outside, so that the compressed air supplied into the upper piston chamber can be effectively used for driving the fasteners.

Preferably, the cylinder has an upper stroke end and a lower stroke end is operable to disconnect the upper piston chamber from the outside when the cylinder is in the upper stroke end. A biasing device may be provided for normally biasing the cylinder in a direction toward the upper stroke end.

With this biasing device, any leakage of the compressed air from the tool can be reliably prevented even when the compressed air has been again supplied from the compressed air supply device after the supply of the compressed air has been stopped. For example, a hose from a compressor may be removed from the tool after the driving operation has been completed. The hose may be again connected to the tool for performing the driving operation. Because the cylinder is held by the biasing device to disconnect the upper piston chamber from the outside, the compressed air supplied to the upper piston chamber may not leak to the outside, so that the piston can reliably return to the lower stroke end or the initial position.

In a preferred representative embodiment, the pneumatic tool further includes a driver guide, a contact arm and a trigger. The driver guide may be vertically movably mounted on a lower portion of the housing. The contact arm may be movable with the driver guide. The trigger may be operable by an operator between a first position and a second position. In the first position, the trigger permits the contact arm to move upward from a lower stroke end for enabling the driving operation of the nails. In the second position, the trigger prevents the contact arm from moving upward from the lower stroke end.

With this embodiment, the driving operation may not be performed unless the operator moves the trigger from the second position to the first position. Therefore, an accidental operation of the tool can reliably be prevented.

Preferably, the trigger includes a stopper. When the trigger is in the second position, the stopper opposes an upper end of the contact arm so as to prevent the contact arm from moving upward from the lower stroke end. The stopper may retract from the opposing position to permit the upward movement of the contact arm from the lower stroke end as the trigger is moved from the second position to the first position.

In another representative embodiment, the pneumatic tool includes a fastener guide and a driving depth adjusting device. The fastener guide may be vertically movably mounted on a lower portion of the housings. The driving depth adjusting device may be operable to change an upper stroke end of the fastener guide.

The driving depth adjusting device may include a stopper block mounted on the fastener guide and a switching member. The switching member may be mounted on the housing so as to vertically oppose to the stopper block.

Preferably, the switching member includes a plurality of stepped surfaces that extend at different levels from each other. The switching member may be operable by an operator so that any one of the stopped surfaces can selectively be positioned to oppose to the stopper block. Therefore, the driving depth can be varied with multiple steps conforming to the number of stepped surfaces.

Each of the additional features and method steps disclosed above and below may be utilized separately or in conjunction with other features and method steps to provide improved pneumatic tool and methods for designing and using such a pneumatic tool. Representative examples of the present invention, which examples utilize many of these additional features and method steps in conjunction, will now be described in detail with reference to the drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe representative and representative examples of the invention.

A detailed description will now be given of a representative example with reference to the accompanying drawings.

FIG. 1 is a view of the representative embodiment showing a nailer 1, which may generally comprise a body 10, a driver guide 50 and a handle 80. The driver guide 50 and the handle 80 extend downward and laterally from the body 10, respectively.

Figure 2:
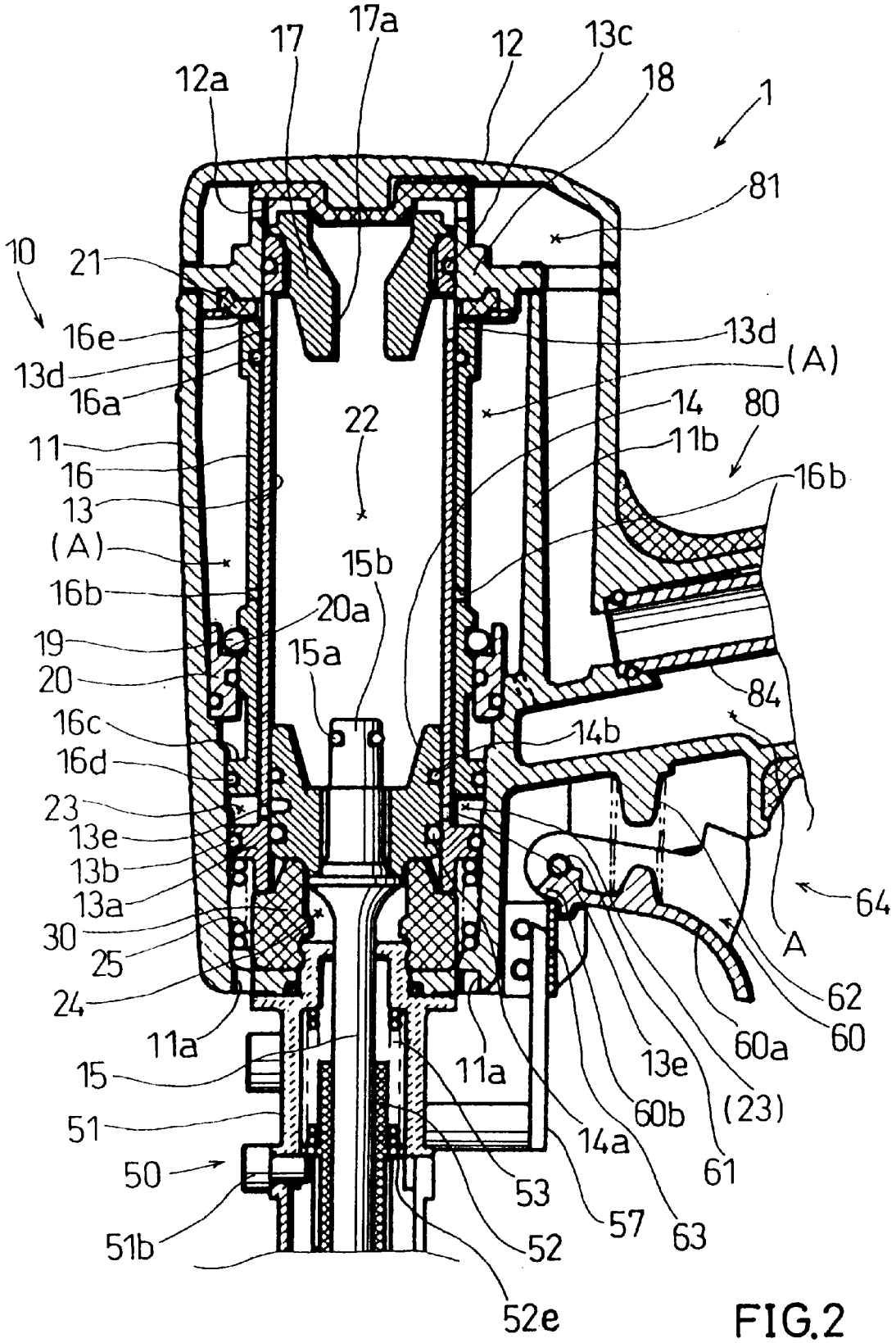
FIG. 2 is an enlarged sectional view of a body of the nailer shown in FIG. 1.

The body 10 is shown in detail in FIG. 2 and preferably includes a hollow housing 10 and a cap 12. The cap 12 is mounted on an upper portion of the housing 10.

A cylinder 13 may be disposed within the housing 10. The cylinder 13 is vertically reciprocally movable within a predetermined range along substantially the central axis of the housing 10. A piston 14 may be vertically reciprocally disposed within the cylinder 13. A driver 15 may be connected to the piston 14 so as to extend through the drive guide 50. The driver 15 serves to drive nails N. When the driver 15 moves downward, a nail N that may be set into the driver guide 50 is driven into a workpiece W (see FIGS. 3 to 10). Preferably, the driver 15 has a protrusion or an upper end 15*b* that extends through the piston 14 to protrude upward from the upper surface of the piston 14. A seal ring 15*a* may be fitted on the upper end 15*b*.

An upper and lower seal rings 14*a* and 14*b* may be fitted on the piston 14 so as to provide an air tight seal between an upper piston chamber 22 and a lower piston chamber 24.

Preferably, the cylinder 13 has a flange 13*a* that is formed with the lower end of the cylinder 13 so as to extend radially outwardly therefrom. A seal ring 13*b* may be fitted on an outer peripheral surface of the flange 13*a*, so that the lower end of the cylinder 13 is slidably movable relative to an inner surface of the housing 11 by means of the seal ring 13*b*.

A compression spring 13*a* may be interposed between the lower surface of the flange 13*a* and an inwardly flanged bottom of the housing 11, so that the cylinder 13 is normally biased upward by the compression spring 13*a*.

Preferably, the upper end of the cylinder 13 is slidably received within a partition plate 18 by means of a seal ring 13*c*. The partition plate 18 is inserted between the cap 12 and the upper end of the housing 11. The upper end of the cylinder 13 may be opened to receive a cylinder cap 17 that includes a central exhaust opening 17*a*. When the piston 14 moves upward, the central exhaust opening 17*a* may receive the upper end of the driver 15, so that the communication between the upper piston chamber 22 and an exhaust channel 81 can be interrupted. The exhaust channel 81 will be explained later.

A seal plate 12*a* may be attached to the inner surface of the cap 12. When the cylinder 13 reaches its upper stroke end as will be explained later, the cylinder cap 17 abuts the seal plate 12*a*, so that the communication between the upper piston chamber 22 and the exhaust channel 81 can also be interrupted. As the cylinder 13 moves downward from its upper stroke end, the cylinder cap 17 moves apart from the seal plate 12*a*, so that the upper piston chamber 22 communicates with the exhaust channel 81 and subsequently with the outside of the nailer 1. Thus, the exhaust channel 81 is formed inside of the housing 11 and the cap 12 and is defined by the partition plate 18 and a partition wall 11*b*, so that the exhaust channel 81 is separated from a pressure accumulation chamber A. The exhaust channel 81 opens to the outside at a rear end of the handle 80 as will be explained later.

Preferably, a plurality of air ports 13*d* are formed in the upper end of the cylinder 13 and are spaced equally from each other in the circumferential direction.

A cylindrical sleeve valve 16 may be slidably fitted on the outer surface of the cylinder 13. A seal ring 16*a* may be fitted on the upper inner surface of the sleeve valve 16 so as to provide an air tight seal between the sleeve valve 16 and the cylinder 13. The sleeve valve 16 may include a plurality of air ports 16*b* formed in substantially the middle portion of the sleeve valve 16 in the vertical direction. The air ports 16*b* are spaced equally from each other in the circumferential direction. Through the air ports 16*b*, the pressure accumulation chamber A always communicates with a clearance that is formed between the sleeve valve 16 and the cylinder 13.

Preferably, a stopper ring 19 is fitted on the outer surface of the sleeve valve 19 in a position below the air ports 16*b*. An annular stopper block 20 may be mounted on the inner wall of the housing 12. The stopper block 20 is positioned upward and opposes to the stopper ring 19. The annular stopper block 20 may have a stepped portion 20*a* that is formed in the inner upper end thereof. The stepped portion 20*a* serves to receive the stopper ring 19 so as to prevent downward movement of the stopper ring 19. Thus, the stopper ring 19 and the stepped portion 20*a* cooperate with each other to limit the lower stroke end of the sleeve valve 16 relative to the housing 11. As the stopper ring 19 moves downward to abut the stepped portion 20*a*, an upper end surface 16*e* of the sleeve valve 16 moves apart from a seal plate 21 that is mounted on the lower surface of the partition plate 18. As a result, the sleeve valve 16 opens to permit communication between the pressure accumulation chamber A and the upper piston chamber 22 of the cylinder 13 via the air ports 13*d*.

On the other hand, when the sleeve valve 16 moves upward from a lower stroke end to an upper stroke end, the upper end surface 16*e* abuts the seal plate 21, so that the sleeve valve 16 is closed. Preferably, the upper end surface 16*e* of the sleeve valve 16 does not entirely abut the seal plate 21 but partly abuts the same by its outer peripheral side portion. Thus, the inner peripheral side portion of the upper end surface 16*e* does not abut the seal plate 21 and is normally exposed to the upper piston chamber 22.

An outwardly extending flange 16*c* may be formed on the lower end of the sleeve valve 16. A seal ring 16*d* is preferably mounted on the outer peripheral surface of the flange 16*c*, so that the lower end of the sleeve valve 16 can be slidably supported within the housing 11 by means of the flange 16*c* and the seal ring 16*d*.

A variable pressure chamber 23 is formed between the flange 16*c* of the sleeve valve 16 and the flange 13*a* of the cylinder 13. The variable pressure chamber 23 always communicates with the pressure accumulation chamber A via a clearance between the cylinder 13 and the sleeve valve 16, and the air ports 16*b*. Preferably, the position of the stopper ring 19 as well as the position of the stepped portion 20*a* is determined such that the flange 16*c* of the sleeve valve 16 may not abut the flange 13*c* of the cylinder 13 even when the sleeve valve 16 reaches the lower stroke, in which the stopper ring 19 abuts the stepped portion 20*a* of the stopper block 20 as described above. This ensures that the variable pressure chamber 23 may always have a sufficient volume irrespective of the operation of the sleeve valve 16.

A plurality of air ports 13*e* may be formed in a lateral wall of the cylinder 13 in a position opposite to the variable pressure chamber 23. When the piston 14 moves upward to a position where the lower seal ring 14*a* is positioned above the air ports 13*e*, the variable pressure chamber 23 communicates with the lower piston chamber 24 via the air ports 13*e*.

A damper 30 may be mounted within a lower end portion of the housing 11. The damper 30 serves to absorb impacts that may be applied to the housing 11 by the piston 14. The damper 30 also serves to limit the lower stroke end of the cylinder 13, so that a clearance 31 may be formed between the lower end of the cylinder 13 and the damper 30 (see FIGS. 7 to 9). A plurality of exhaust openings 1 la may be formed in the bottom of the housing 11, so that the lower piston chamber 24 can open to the outside via the clearance 31 and the exhaust openings 11*a*.

Referring to FIG. 1, a substantially cylindrical support sleeve 51 may be connected to the bottom of the housing 11. The support sleeve 51 extends downward from the housing 11 on the same axis as the piston 14 or the cylinder 13. A nail guide 54 and a drive guide 52 may be disposed within the support sleeve 51. Both the nail guide 54 and the drive guide 52 have a cylindrical configuration and are positioned coaxial with the support sleeve 51. In addition, the nail guide 54 and the drive guide 52 are vertically movable relative to the support sleeve 51 independently of each other.

A compression spring 55 may be interposed between the lower end of the support sleeve 51 and a lower flanged portion of the nail guide 54 that extends downward from the support sleeve 51. Therefore, the nail guide 54 is normally biased in a downward direction or a nail driving direction.

A stopper block 54*a* is formed on the upper end of the nail guide 54 and extends laterally from the nail guide 54. An axially elongated guide slot 51*a* is formed in the support sleeve 51, so that the stopper block 54*a* extends outwardly through the guide slot 51*a*. Therefore, the lower stroke end of the nail guide 54 may be limited through abutment of the stopper block 54*a* to the lower end of the guide slot 51*a*. In addition, the stopper block 54*a* is one of the components of a driving depth adjusting mechanism that permits the lower stroke end of the nail guide 54 to be changed in a step-by-step mariner as will be explained later.

The lower end of the nail guide 54 may have an abutting surface 54*b* for abutment to a workpiece W, into which nails N are to be driven. Preferably, as shown in FIG. 1, the abutting surface 54*b* is inclined by a small angle relative to a horizontal plane that is perpendicular to the axis of the nail guide 54. Most preferably, the abutting surface 54*b* is inclined upward in a direction away from a gravity center G of the nailer 1, so that the length of the nail guide on the side of the gravity center G is greater than that on the side opposite to the gravity center G. In the preferred representative embodiment shown in the drawings, the gravity center G is positioned on the right side of the driver 15 as viewed in FIG. 1. Therefore, the abutting surface 54*b* is inclined upward in a leftward direction in FIG. 1. With the abutting surface 54*b* thus inclined, the nails can he prevented from being removed from the drive guide 54 irrespective of a reaction force that may be applied to the driver guide 54 during the nail driving operation. FIGS. 14(A) to 14(D) illustrate how the inclined abutting surface 54*b* operates.

Figure 14A:
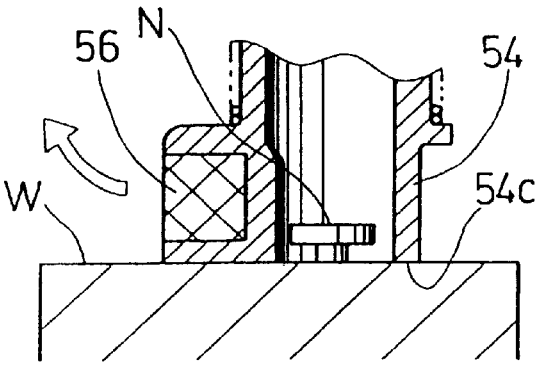
PRIOR ART FIG.14(A)
FIGS. 14(A) and 14(B) are explanatory views showing the operations of a nail guide having a non-inclined lower end according to a conventional nailer.
Figure 14C:
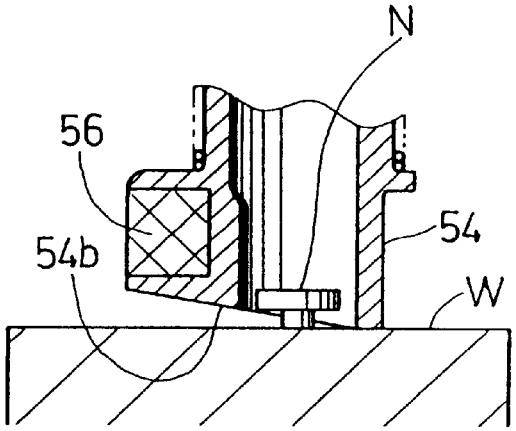
Figure 14B:
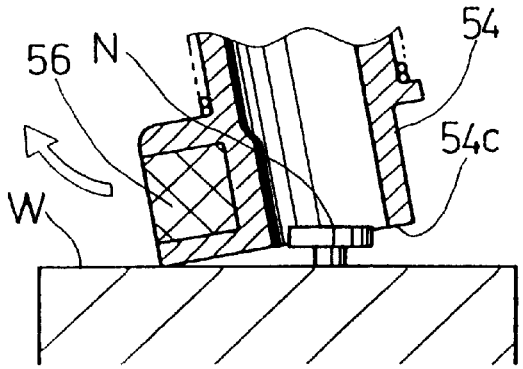
PRIOR ART FIG.14(B)
Figure 14D:
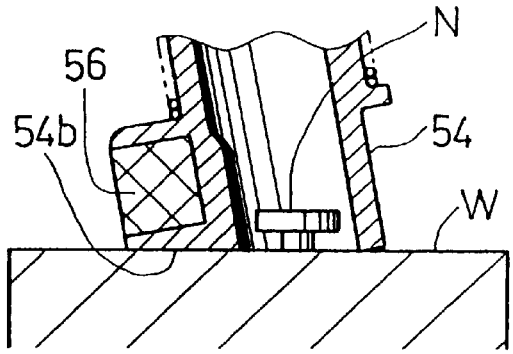

FIGS. 14(A) and 14(B) have been incorporated for illustrating a conventional construction, in which an abutting surface 54*c* extends perpendicular to the axis of the driver 15 or the driver guide 54. FIGS. 14(C) and 14(D) correspond to FIGS. 14(A) and 14(B), respectively, but illustrate the operations of the inclined abutting surface 54*b* of the preferred representative embodiment described above.

In case of the conventional construction, the non-inclined abutting surface 54*c* is placed to entirely abut the upper surface of the workpiece W for driving a nail N. When the nail N is driven into the workpiece W, a reaction force is applied to the drive guide 54. Because the gravity center G of the nailer 1 is positioned on the right side of the driver guide 54 as viewed in FIG. 14(A), the reaction force tends to pivot the nailer 1 in a direction indicated by arrow in FIG. 14(A) or a direction to pivot the nailer 1 in a clockwise direction as viewed in FIG. 14(A).

As the number of impact blows applied to the nail N increases, the reaction force may increase, so that the tendency of pivotal movement of the nailer 1 may become greater to cause a "shaking" movement of the nailer 1. In addition, the nail driving operation is normally performed by pressing the nailer 1 against the workpiece W with the handle 80 grasped by hands of an operator. Therefore, it is liable that a pressing force in a forward direction is applied to the nailer 1 in addition to the vertical pressing force. As a result, the nailer 1 as well as the nail guide 54 may be pivoted to a position as shown in FIG. 14(B).

For this reason, with the conventional nailer having the non-inclined abutting surface 54*c*, the right side of the abutting surface 54*c* is lifted upward from the workpiece W as shown in FIG. 14(B). If the nail driving operation is performed in the state of FIG. 14(B), the nail guide 54 may be displaced horizontally from the nail N by the reaction force. In such a case, further impact blows cannot be applied to the nail N.

In contrast, with the nailer 1 having the inclined abutting surface 54*b* of the preferred representative embodiment, the abutting surface 54*b* may substantially entirely abut the workpiece W as shown in FIG. 14(D) when the nail guide 54 or the nailer 1 is inclined by the reaction force in the clockwise direction as viewed in FIG. 14(C). Therefore, the right side of the abutting surface 54*b* may not be lifted even when the reaction force is applied to the nail guide 54. As a result, the nail guide 54 can be held in position relative to the nail N, so that the nail N can he driven into the workpiece W with a number of impact blows until it is completely driven.

Further, a magnet 56 may be mounted on the lower end of the nail guide 54 on the lateral side thereof. The magnet 56 serves to attract the nail N set into the nail guide 54 so as to hold the nail N in position.

The driver guide 52 has a lower end that extends into the nail guide 54. A compression spring 53 may be disposed within the support sleeve 51 so as to be interposed between an upper closure of the support sleeve 51 and an outwardly extending flange 52*e* 25 that is formed with the driver guide 52. Therefore, the driver guide 52 is biased in the downward direction or the nail driving direction.

A stopper bolt 51*b* may be screwed laterally into the support sleeve 51 in a position below the flange 52*e*. The stopper bolt 51*b* has a front end that extends into the support sleeve 51, so that the lower stroke end of the driver guide 52 is limited through abutment of the flange 52*e* to the front end of the stopper bolt 51*b*. The driver 15 is slidably inserted into the driver guide 52 such that there is no substantial play in the diametrical direction.

Figure 12:
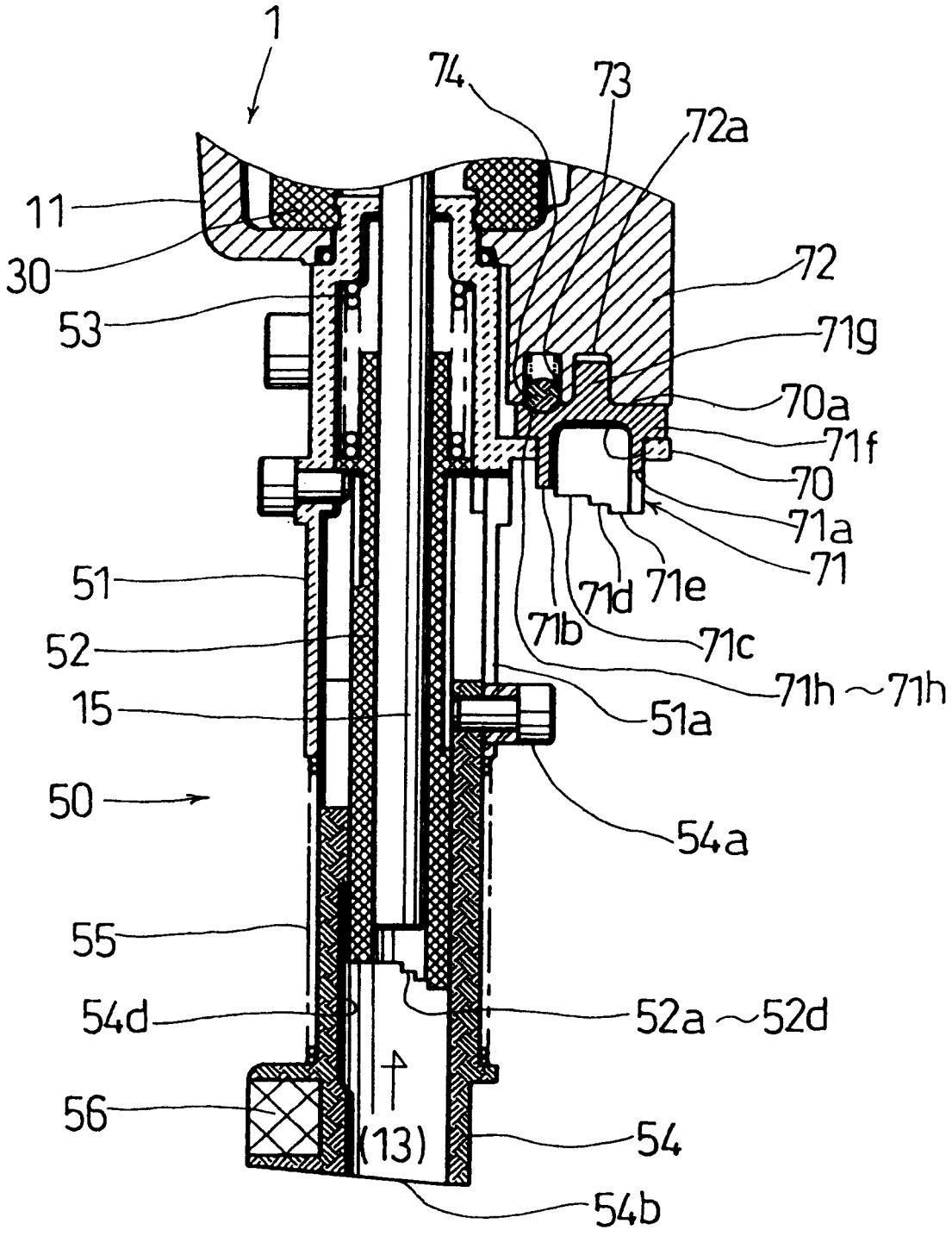
FIG. 12 is a sectional view of the nail guide mechanism including a driving depth adjusting mechanism of the nailer.
Figure 13A:
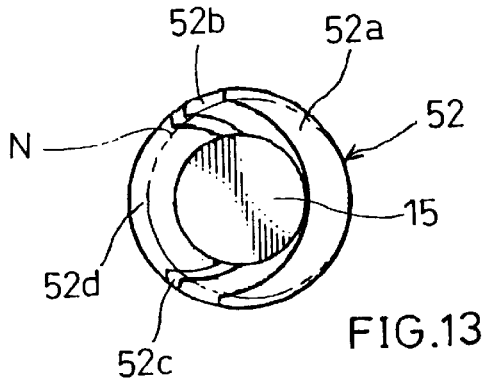
FIG. 13(A) is a bottom view of a nail guide of the nailer as viewed in a direction of arrow (13) in FIG. 12.
Figure 13B:
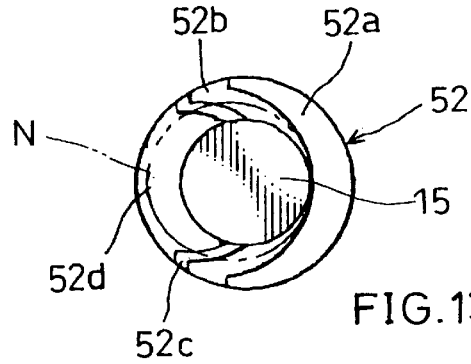
FIGS. 13(B) to 13(D) are views similar to FIG. 13(A) but showing nails with heads having different sizes.
Figure 13C:
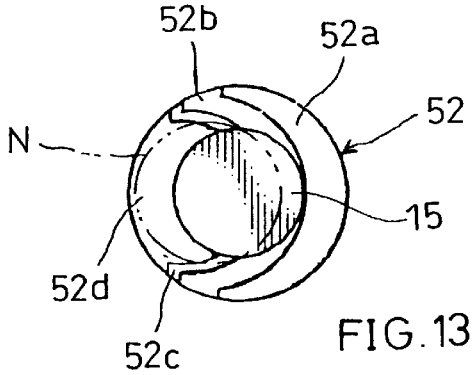
Figure 13D:
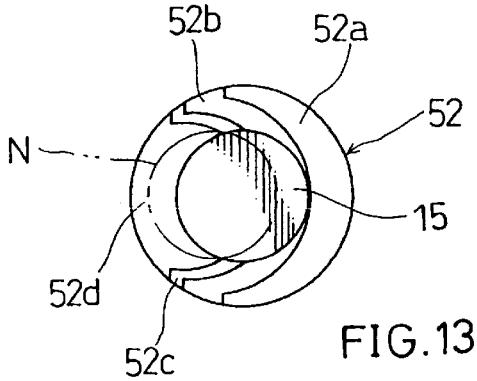

As shown in FIGS. 12 and 13, the lower end of the driver guide 52 may have stepped portions 52*a* to 52*d*. The levels of the stepped portion 52*a*, 52*b*, 52*c* and 52*d* become lower in this sequence. The stepped portions 52*a* to 52*d* serve to contact heads of their corresponding nails having different head sizes, respectively, as shown in FIGS. 13(A) to 13(D). Thus, the sizes of the nail heads determined for contacting the stepped portions 52*a*, 52*b*, 52*c* and 52*d* become greater in this sequence. The stepped portions 52*a*, 52*b* and 52*c* have arc-shaped side edges for engaging the heads of nails contacting the stepped portions 52*b*, 52*c* and 52*d*, respectively. The arc-shaped side edges of the stepped portions 52*a*, 52*b* and 52*c* are arranged in this sequence in the left direction as viewed in FIGS. 13(A) to 13(D). Therefore, the smaller the size of the head of the nail is, the shorter the distance between the nail N and the magnet 56 mounted on the nail guide 54 becomes. As a result, the nail N can be set into the nail guide 54 with a smallest tilt angle from an upright position even if the nail N is one having a smallest head size.

Preferably, an axially elongated recess 54*d* is formed in the inner wall of the nail guide 54. The recess 54*d* serves to receive a left side part of the head of the nail N so as to permit the nail N to be attracted by the magnet 56 in a position close to an upright position.

Figure 11B:
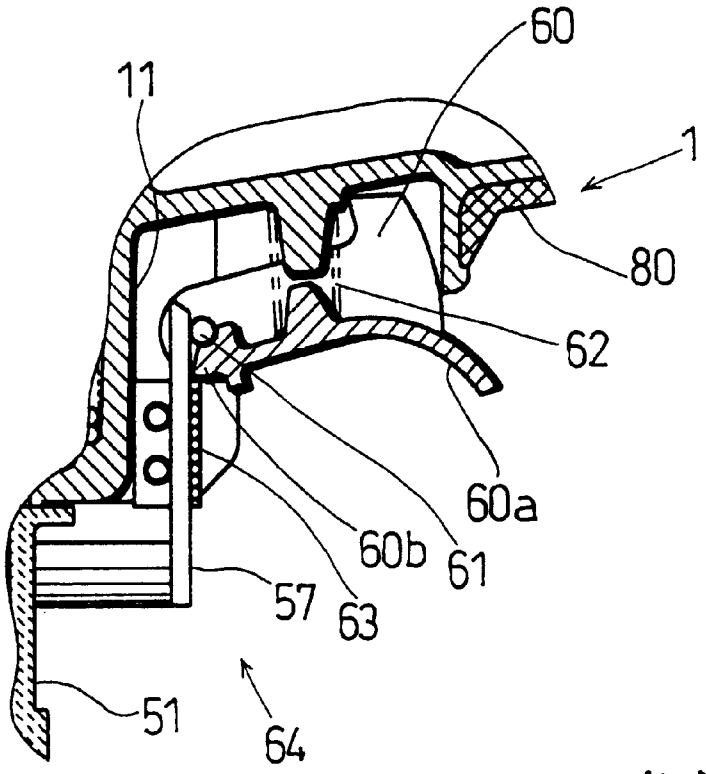
FIG. 11(B) is a view similar to FIG. 11(A) but showing the operation, in which a contact arm has been moved upward after a trigger has been pulled.
Figure 11A:
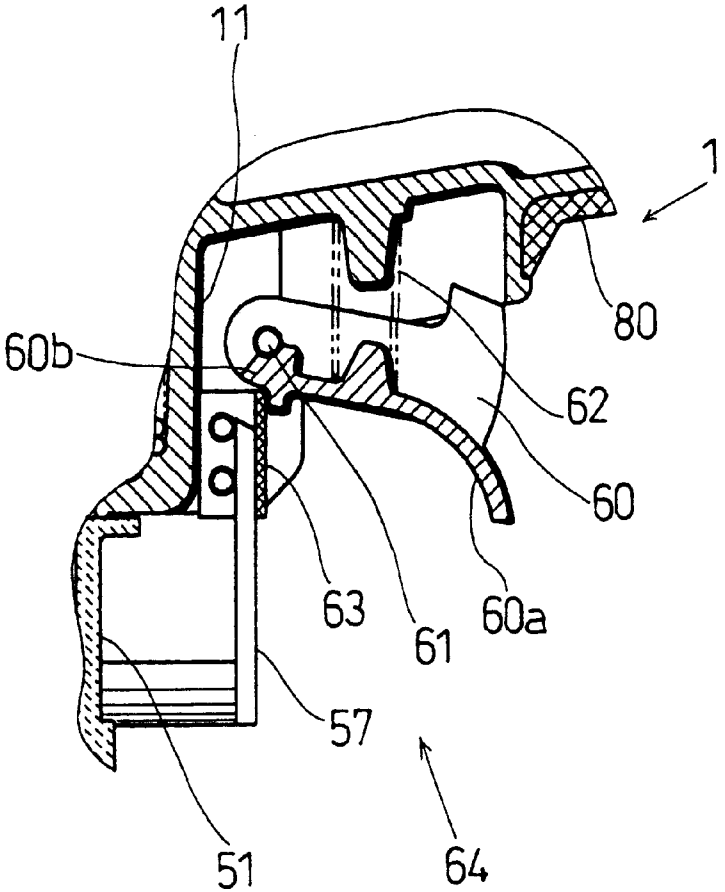
FIG. 11(A) is an enlarged sectional view of a safety device of the representative embodiment of the nailer.

A contact arm 57 may be integrally formed with the upper end of the driver guide 52. As shown in FIGS. 1, 11(A) and 11(B), the contact arm 57 extends upward to a position adjacent a trigger 60 that is disposed on the lower side of the left end of the handle 80. The trigger 60 is pivotally mounted on the lateral side of the lower end of the housing 11 by means of a pivot pin 61. A compression spring 62 may be interposed between the lower side of the handle 80 and the trigger 60 so as to normally bias the trigger 60 in a clockwise direction as viewed in FIG. 11(A).

Preferably, a substantially U-shaped bracket 63 is mounted on the housing 11 in a position below and adjacent the pivotal pin 61. The bracket 63 serves to guide the upper end of the contact arm 57 when the contact arm 57 moves vertically together with the driver guide 52.

The trigger 60 has a wall part 60*a* that extends rightward from the pivot pin 61 as viewed in FIG. 11(A). A stopper portion 60*b* is formed with the left side end of the wall part 60*a* and protrudes leftward from the wall part 60*a* in the state shown in FIG. 11(A). In the state of FIG. 11(A), the stopper portion 60*b* is positioned right above the upper end of the contact arm 57. In addition, the trigger 60 is not pulled by an operator and is held in an off position by the compression spring 62. Because the stopper portion 60*b* is positioned right above the upper end of the contact arm 57, the contact arm 57 as well as the driver guide 52 is prevented from moving upward. With the driver guide 52 thus prevented from the upward movement, the piston 14 may not be moved upward even if the nailer 1 is pressed against the workpiece W. Thus, a drive lock state for preventing the driving operation of the nails can he realized.

When the operator pulls the trigger 60 in the state of FIG. 11(A), the stopper portion 60*b* of the wall portion 60*a* retracts from the moving path of the contact arm 57 as shown in FIG. 11(B), so that the contact arm 57 as well as the driver guide 52 can be moved upward. Therefore, the nails can be driven into the workpiece W when the operator presses the nailer 1 against the workpiece W. Thus, a lock releasing state can be realized.

Because, the nailer 1 cannot be operated to drive nails in the drive lock state, the trigger 60 constitutes a safety device 64 for preventing an accidental driving operation of nails. The conventional nailer, such as a nailer disclosed in Japanese Patent Publication No. 48-12913), does not have such a safety device.

Referring to FIG. 1, the handle 80 comprises a substantially cylindrical handle housing 85 and a handle cap 86 mounted on the front end (a right end as viewed in FIG. 1) of the handle housing 85. The rear end of the handle housing 85 is integrally formed with the lateral side of the housing 11. The pressure accumulation chamber A described above is formed in the handle housing 75 and occupies the substantial portion of the space within the handle housing 75. The pressure accumulation chamber A communicates with a space within the housing 11, which space is formed to surround the sleeve valve 16.

The handle cap 86 may be secured to the handle housing 85 by means of bolts 87. The handle cap 86 has a male coupler 82 mounted thereon, which male coupler may be connected to a female coupler of an air hose that is connected to a compressor (not shown). Therefore, the compressed air can be supplied to the pressure accumulation chamber A. A disc-like filter 82*a* may be mounted within the handle housing 85 at the inlet of the pressure accumulation chamber A, so that foreign particles may not enter the pressure accumulation chamber A.

In addition, an exhaust ring 83 may be rotatably mounted between the handle housing 85 and the handle cap 86.

The exhaust channel 81 formed within the housing 11 is connected to an exhaust chamber B formed within the handle cap 86 via an exhaust pipe 84. The exhaust chamber B is sealingly separated from the pressure accumulation chamber A and opens to the outside via an exhaust opening 83*a* that is formed in the exhaust ring 83. If desired, the exhausting direction of the air from the exhaust chamber B can be changed by rotating the exhaust ring 83. Therefore, the operability can be improved. In order to provide such an exhausting direction changing function, it is preferable that the number of the exhaust opening 83*a* is one or two. In contrast, if the exhausting efficiency is to be improved rather than the change in direction, the number of the exhaust opening 83*a* may be determined to be three or more.

The operation of the nailer 1 of the above representative embodiment will now be described.

FIGS. 3 to 10 show the operations of the nailer 1 in this sequence. In FIGS. 3 to 10, the handle portion 80 is omitted for the purpose of illustration.

Figure 3:
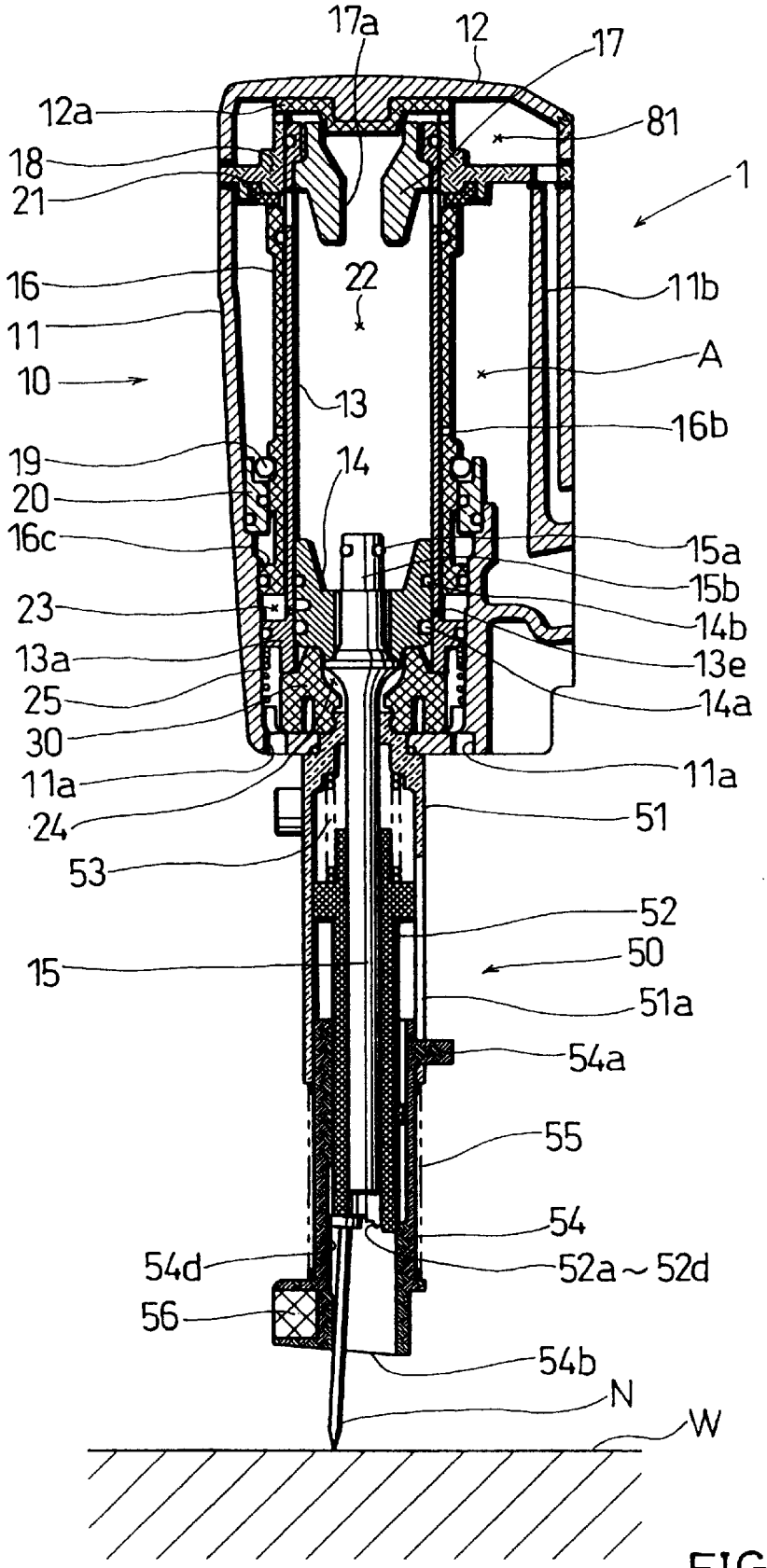
FIG. 3 is a vertical sectional view of the body and a nail guide mechanism of the nailer, and showing die operation when the nailer is in a non-operative position.

FIG. 3 shows the non-operative state of the nailer 1, in which the compressed air has been supplied to the pressure accumulation chamber A. In this state, the piston 14 is positioned in the lower stroke end and abuts the damper 30, so that the lower seal ring 14*a* is positioned below the air ports 13*c*. Therefore, the lower piston chamber 24 is disconnected from the variable pressure chamber 23. The variable pressure chamber 23 communicates with the pressure accumulation chamber A, via the air ports 16*b* and the clearance between the sleeve valve 16 and the cylinder 13, so that the pressurized air is supplied to the variable pressure chamber 23. The pressure in the variable pressure chamber 23 is applied to the flange 13*a* of the cylinder 13, so that the cylinder 13 is held in the lower stroke end against the biasing force of the compression spring 25.

The pressure of the variable pressure chamber 23 also is applied to the flange 16*c* of the sleeve valve 16, so that the sleeve valve 23 is held in the upper stroke end, in which the upper end surface 16*c* of sleeve valve 16 abuts the seal plate 21. Therefore, the upper piston chamber 22 is disconnected from the pressure accumulation chamber A. In addition, because the cylinder 13 is positioned in the lower stroke end, the cylinder cap 17 mounted on the upper end of the cylinder 13 is apart from the seal plate 12*a*. Therefore, the upper piston chamber 22 opens to the outside via the central exhaust opening 17*a* and the exhaust channel 81.

Further, in the state of FIG. 3, the nail guide 54 and the driver guide 52 are held in the lower stroke end by the biasing force of the compression springs 55 and 53, respectively. In addition, the trigger 60 is not pulled by the operator, so that the nailer 1 is held in the drive lock state.

The operator then sets a nail N into the nail guide 54 such that the head of the nail N abuts one of the stepped portions 52*a* to 52*d* of the driver guide 52 that is suited to the size of the nail head. The nail N thus set is held in position by the attracting force of the magnet 56.

Thereafter, the operator grasps the handle 80 with his hand and sets the nailer 1 on the workpiece W such that the nail N abuts the workpiece W while the nail guide 54.is position to extend perpendicular to the workpiece W. The operator then pulls the trigger 60, so that the nailer 1 becomes the lock releasing state.

Subsequently, the operator presses the nailer 1 against the workpiece W to start the nail driving operation.

Figure 4:
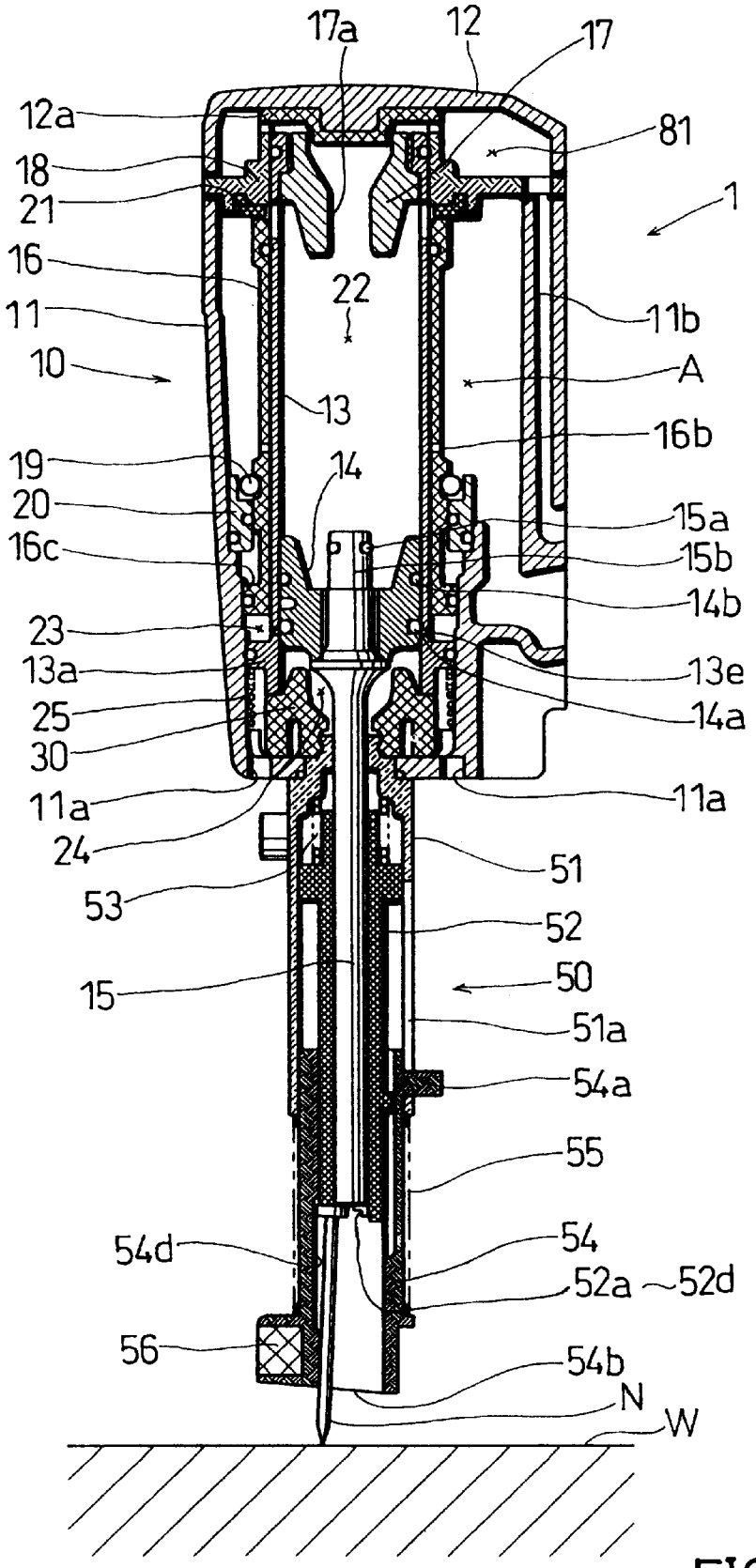
FIG. 4 is a view similar to FIG. 3 but showing the operation, in which the nailer has been pressed against a workpiece to move a piston upward by a little distance.

Thus, when the operator presses the nailer 1 against the workpiece W, the driver guide 52, to which the nail 1 abuts, moves upward relative to the support sleeve 51 against the biasing force of the compression spring 53. In addition, the driver 115 as well as the piston 14 also moves upward through abutment to the head of the nail N as shown in FIG. 4. As for the nail guide 54, it abuts the workpiece W after the nail N has been driven into the workpiece W to some extent as will be explained later.

When the lower seal ring 14*a* of the piston 14 has been moves to a position above the air ports 13*e*, the lower piston chamber 24 communicates with the variable pressure chamber 23 via the air ports 13*c*, so that the compressed air is supplied to the lower piston chamber 24. As a result, the piston 14 is abruptly lifted by the air pressure. At this stage, the upper piston chamber 22 still opens to the outside, because the cylinder 13 is held in the lower stroke end.

Figure 5:
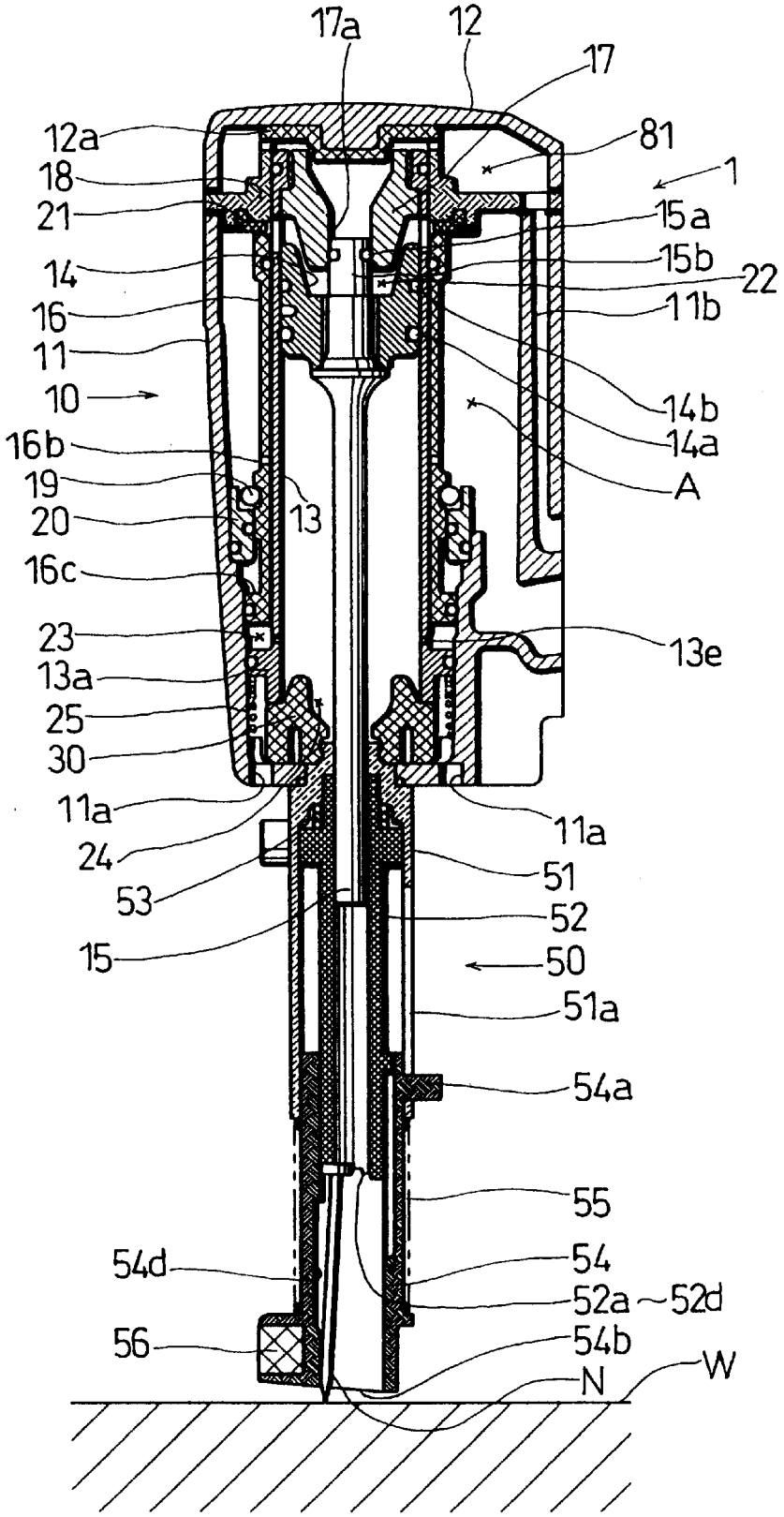
FIG. 5 is a view similar to FIG. 3 but showing the operation, in which the compressed air has been supplied to a lower piston chamber to abruptly move the piston.
Figure 6:
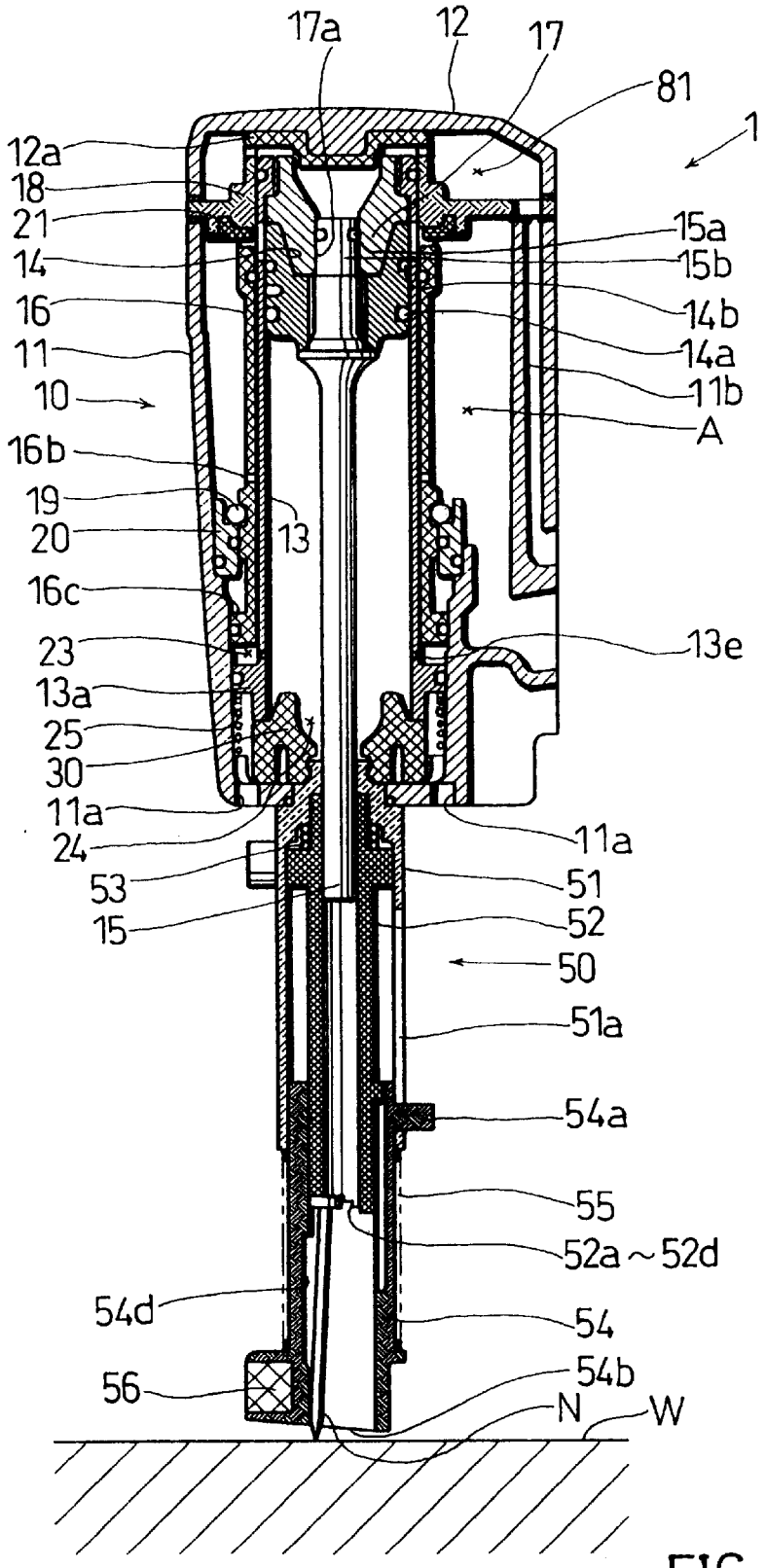
FIG. 6 is a view similar to FIG. 3 but showing the operation, in which a sleeve valve has been moved downward by the compressed air supplied to an upper piston chamber.

The piston 14 further moves upward, so that the protrusion 15*b* enters the central opening 17*a* of the cylinder cap 17*a*. As a result, the upper piston chamber 22 is closed as shown in FIG. 5. With the upper piston chamber 22 thus closed, the air within the upper piston chamber 22 is compressed as the piston 14 further moves upward. The pressure produced in the upper piston chamber 22 in this manner is applied to the upper end surface 16*e* of the sleeve valve 16, so that the sleeve valve 16 moves downward as shown in FIG. 6.

Figure 7:
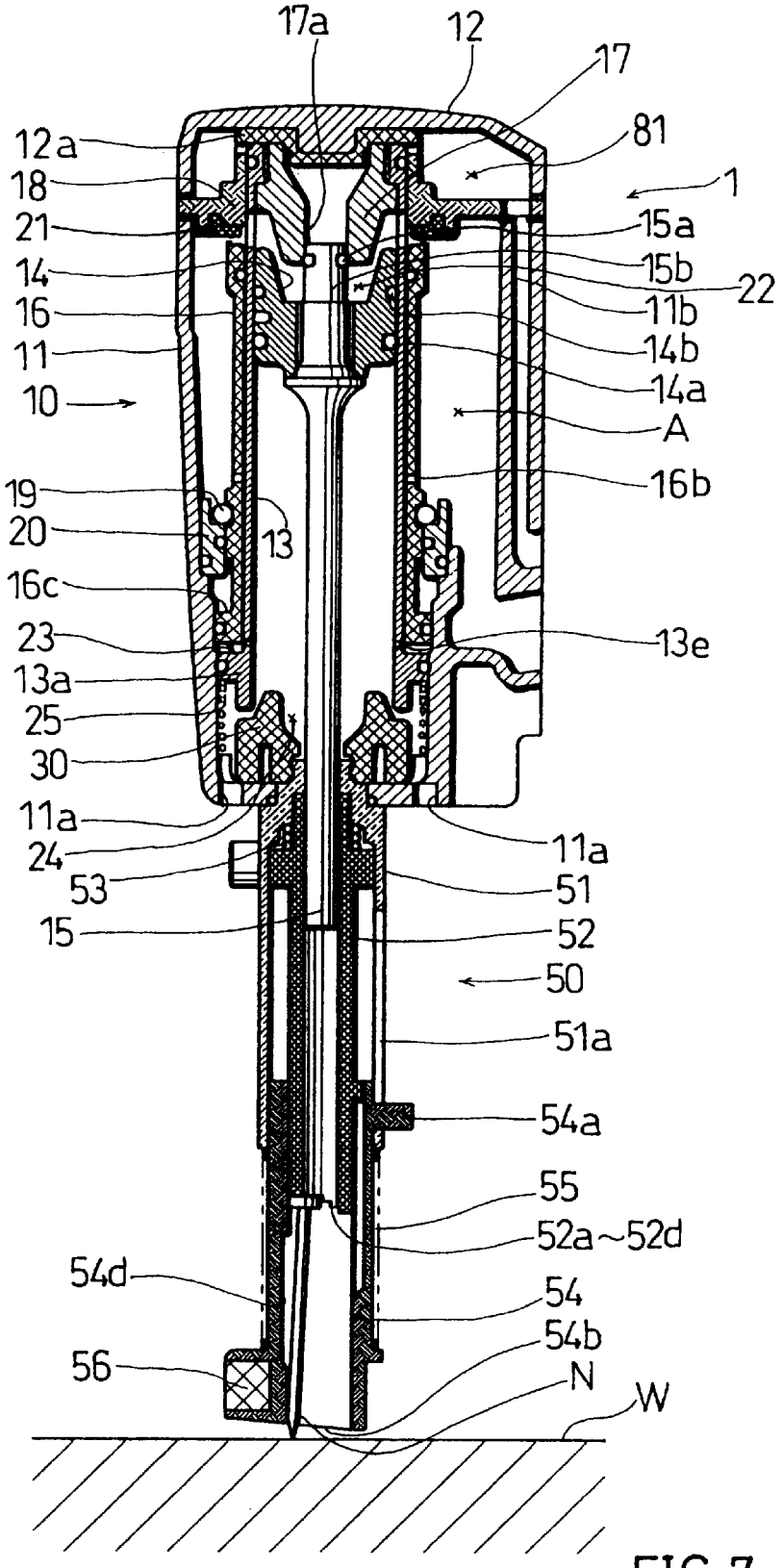
FIG. 7 is a view similar to FIG. 3 but showing the operation, in which a cylinder has been moved upward by the compressed air supplied to the upper piston chamber, so that the lower piston chamber has opened to the outside.

The sleeve valve 16 continues its downward movement until the stopper ring 19 abuts the stepped portion 20*a* of the stopper block 20. When the sleeve valve 16 reaches the lower stroke end, the upper piston chamber 22 opens to the pressure accumulation chamber A, so that the compressed air flows into the upper piston chamber 22. The pressure of the compressed air is then applied to the lower surface of the cylinder cap 17, so that the cylinder 13 moves upward as shown in FIG. 7.

Figure 8:
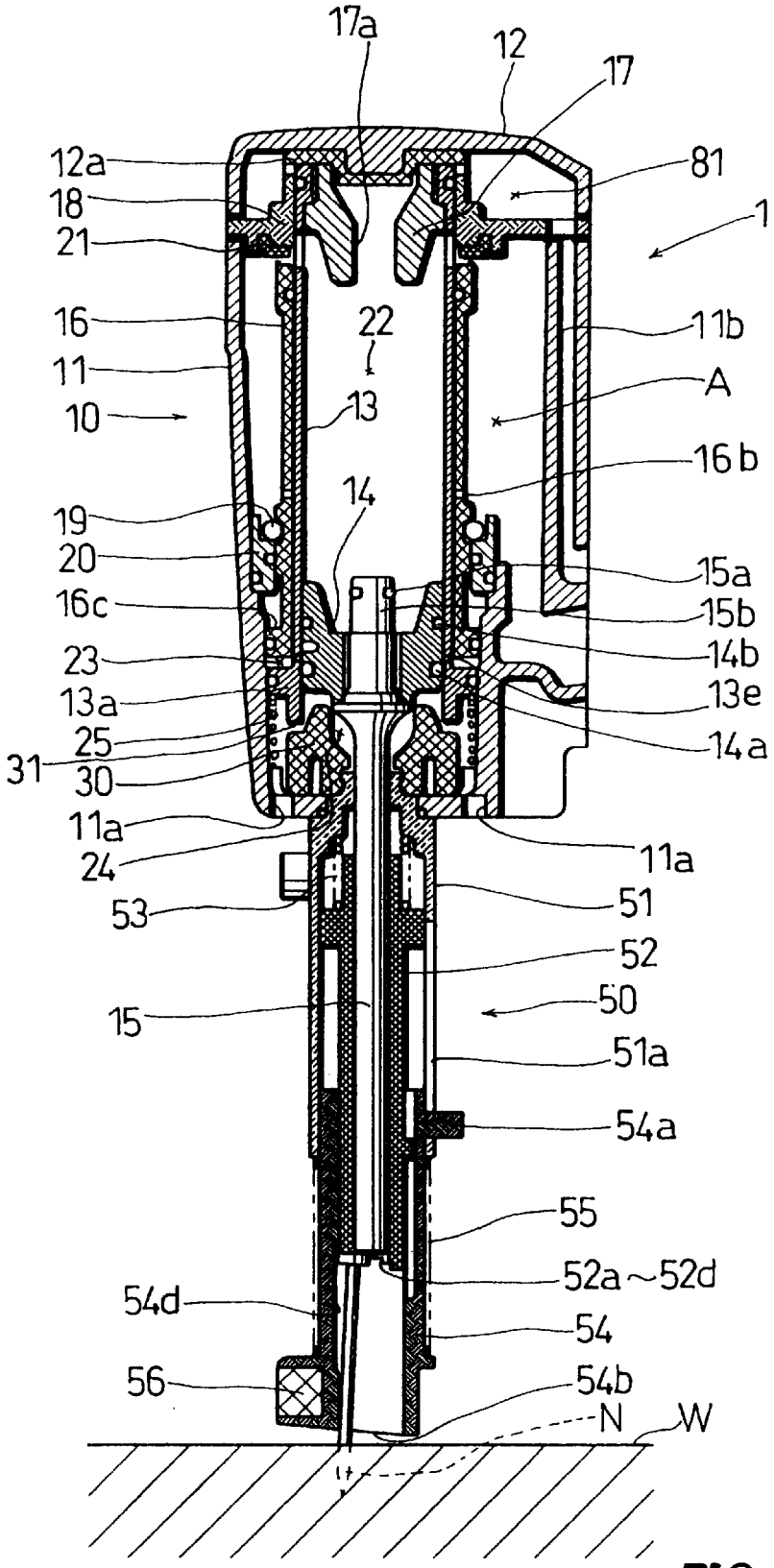
FIG. 8 is a view similar to FIG. 3 but showing the operation, in which the piston has been abruptly moved downward by the compressed air supplied to the upper piston chamber, so that a nail has been driven into the workpiece.

As the cylinder 13 moves upward, the cylinder cap 17 is pressed against the seal plate 12*a*, so that the upper piston chamber 22 is disconnected from the exhaust channel 81 or the outside. At the same time, a clearance 31 (see FIG. 8) is formed between the lower end of the cylinder 13 and the damper 30, so that the lower piston chamber 24 opens to the outside via the exhaust openings 11*a*. When the lower piston chamber 24 thus opens to the outside, the pressurized air supplied to the upper piston chamber 22 abruptly lowers the piston 14, so that a first impact blow is applied by the driver 15 to the head of the nail N as shown in FIG. 8.

At this stage, the sleeve valve 16 is still held in position through abutment of the stopper ring 19 to the stepped portion 20*a* of the stopper block 20, while the cylinder 13 is in the upper stroke end. Therefore, the flange 16*c* of the sleeve valve 16 and the flange 13*a* of the cylinder 13 may be spaced from each other by at least a distance as shown in FIG. 8. Thus, the variable pressure chamber 23 maintains at least a substantial volume even if it has opened to the outside. Therefore, during the upward movement of the cylinder 13, the sleeve valve 16 can be reliably held in the lower stroke end (an open position) and does not interfere with the supply ot the compressed air to the upper piston chamber 22.

As the piston 13 is moved upward to open the lower piston chamber 23 to the outside as described above, the variable pressure chamber 23 opens to the atmosphere via the air ports 13*e*. On the other hand, the variable pressure chamber 23 still communicates with the pressure accumulation chamber A via the clearance between the cylinder 13 and the sleeve valve 16. However, the total sectional area of the air ports 13*e* is determined to be substantially greater than the sectional area of the air port 16*b*. Therefore, the variable pressure chamber 23 can be held at substantially the same pressure as the outside, irrespective of the flow of the compressed air from the pressure accumulation chamber A.

Figure 9:
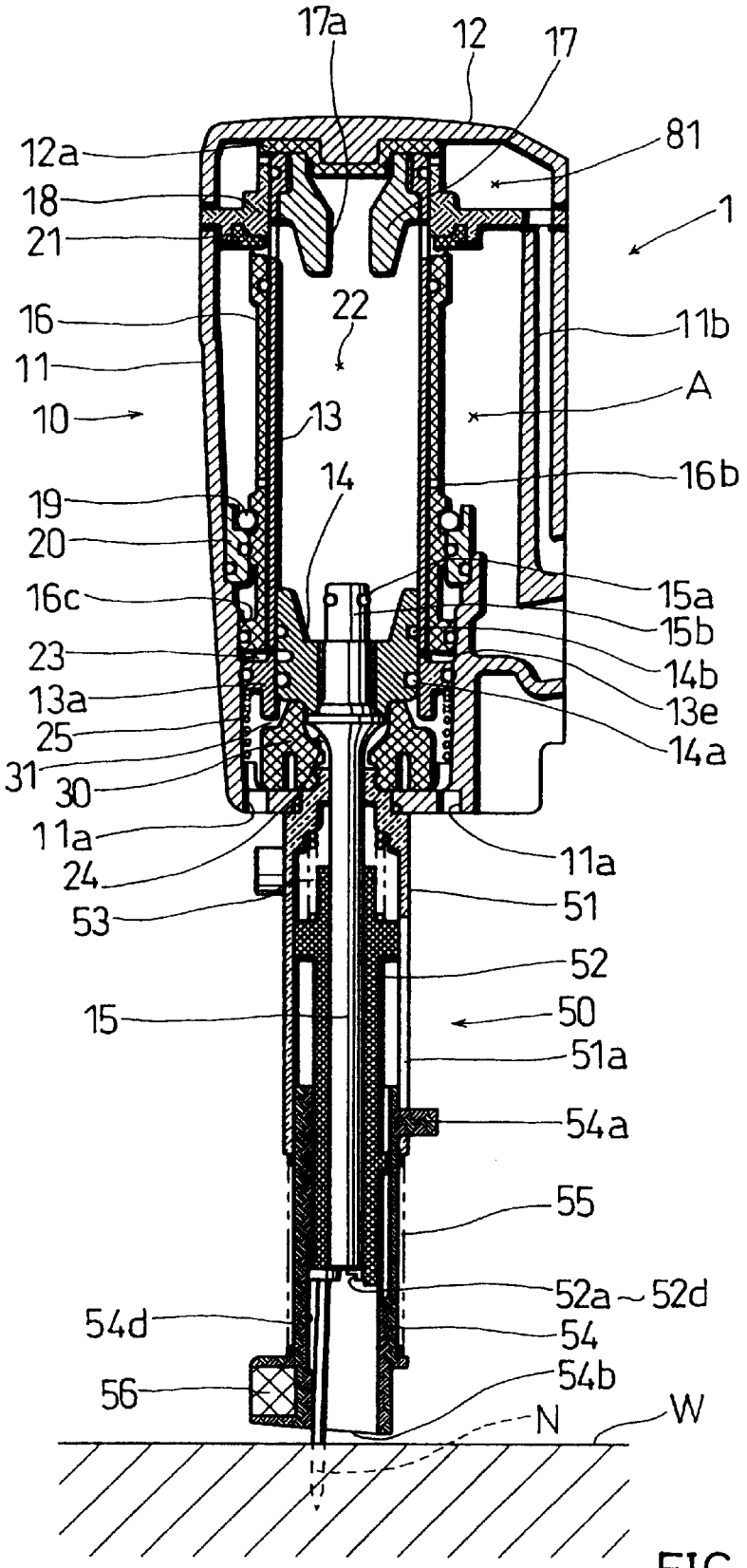
FIG. 9 is a view similar to FIG. 3 but showing the operation, in which the piston has reached the lower stroke end, and in which the sleeve valve and the cylinder are positioned at the lower stroke end and the upper stroke end, respectively, because the pressure within a variable pressure chamber has not as yet been sufficiently increased.

The first impact blow of the nail is completed when the piston 14 reaches the lower stroke end as shown in FIG. 9. During the movement of the piston 14 toward the lower stroke end, the lower seal ring 14*a* is shifted below the air ports 1, so that the variable pressure chamber 23 is disconnected from the lower piston chamber 24 that opens to the outside. Therefore, the variable pressure chamber 23 is again pressurized by the air supplied from the pressure accumulation chamber A.

Figure 10:
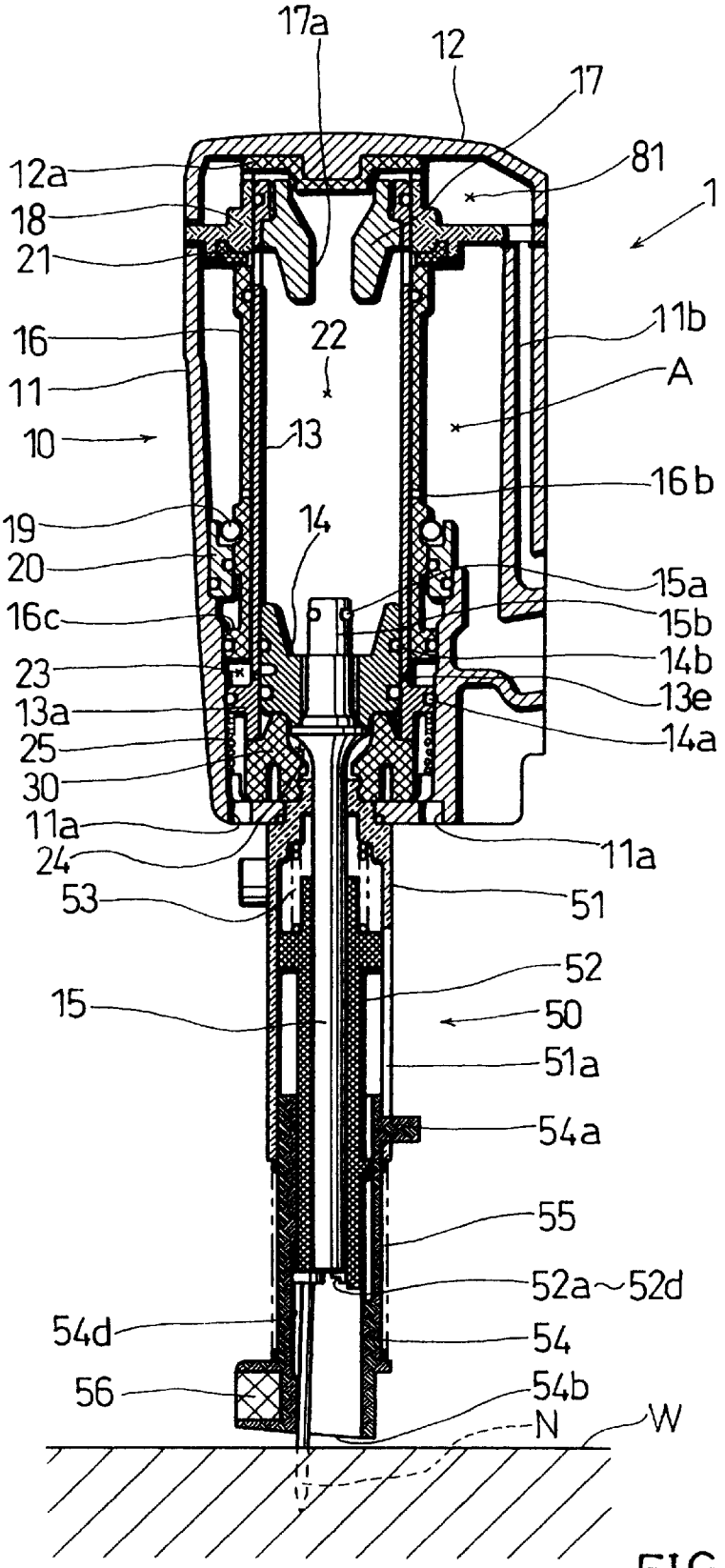
FIG. 10 is a view similar to FIG. 3 but showing the operation, in which one impact blow of the nail has been completed.

The pressure within the variable pressure chamber 23 is applied to the lower surface of the flange 16*c*, so that the sleeve valve 16 moves upward to disconnect the upper piston chamber 22 from the pressure accumulation chamber A Therefore, the supply of the compressed air to the upper piston chamber 22 is stopped. The pressure within the variable pressure chamber 23 also is applied to the upper surface of the flange 13*a*, so that the cylinder 13 moves downward against the biasing force of the compression spring 25 Then, the cylinder cap 17 moves apart from the seal plate 12*a* to connect the upper piston chamber 22 to the exhaust channel 81 and consequently to the outside. One cycle of the driving operation of the nailer 1 is thus completed. FIG. 10 shows the state, in which the driving operation has been completed. The operator can repeatedly perform the above cycle by repeatedly pressing the nailer 1 against the workpiece W. As a result, multiple impact blows can be applied to the nail N so as to drive the nail N in a step-by-step manner.

As described above, according to the representative embodiment of the nailer 1, the 2*a* position of the stopper ring 19 as well as the position of the stepped portion 20*a* of the stopper block 20 is determined such that the flange 16*c* of the sleeve valve 16 may not abut the flange 13*a* of the cylinder 13 when the sleeve valve 16 is in the lower stroke end (the position shown in FIG. 6). Therefore, the variable pressure chamber 23 always has at least a predetermined volume. For this reason, during the upward movement of the cylinder 13 caused by the pressure within the upper piston chamber 22, the sleeve valve 16 can reliably be held in the lower stroke end, so that the flow of the compressed air into the upper piston chamber 22 can be reliably maintained. As a result, the piston 14 can perform a long stroke movement.

By determining the stroke of the piston 14 to have a long distance, the body 10 may have an elongated configuration in the vertical direction, so that the nailer 1 can be reliably operated even in a narrow workplace. Therefore, the operability of the nailer 1 can be improved.

The device for ensuring the sufficient volume of the variable pressure chamber 23 may not be limited to the construction described above. For example, the stopper ring 19 may be replaced by an annular protrusion integrally formed with the outer surface of the sleeve valve 16, so that the annular protrusion may abut the stopper block 20 for limiting the lower stroke end of the sleeve valve 16.

In the meantime, because the cylinder 13 is normally biased upward by the compression spring 25, possible leakage of the compressed air from the upper piston chamber 22 can reliably be prevented. As a result, the piston 14 can reliably return to its initial position.

Figure 19:
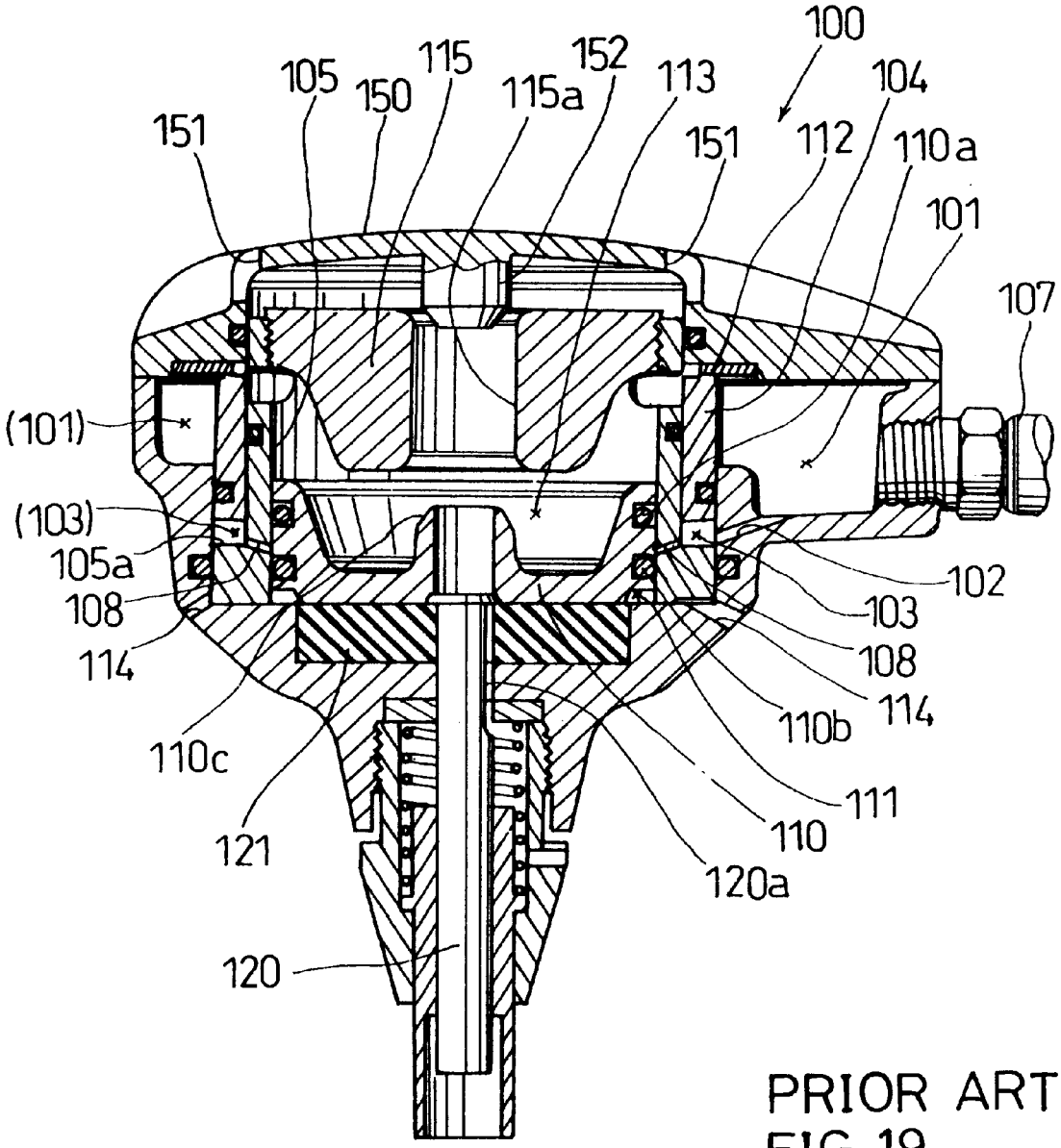
PRIOR ART FIG.19
FIG. 19 is a vertical sectional view of a conventional nailer.

Thus, in case of the conventional nailer 100 shown in FIG. 19, the compressed air accumulated within the pressure accumulation chamber 101 may be ejected to the outside when the air hose 107 has been removed from the nailer 100 after use of the nailer 100, In this state, when vibrations have been applied to the nailer 100 or when the position of the nailer 100 has been changed for some reason or other, the piston 10 may move from the initial position (lower stroke end). If the piston 110 has been moved such that the lower seal ring 110*b* is positioned above the air ports 108, the variable pressure chamber 103 may communicate with the lower piston chamber 111, which chamber opens to the outside via the air ports 101. In addition, the upper piston chamber 13 may communicate with the pressure accumulation chamber 101, so that the upper piston chamber 13 opens to the outside.

In this state, when the air hose 107 is again connected to the nailer 100 to supply the compressed air to the pressure accumulation chamber 101, the pressure variation chamber 103 may not be sufficiently pressurized. Therefore, the sleeve valve 104 may move from the upper stroke end (close position), and the cylinder 105 may move from the lower stroke end. In such a case, the pressurized air may enter the upper piston chamber 113 from the pressure accumulation chamber 101. The pressurized air may further leak to the outside from the exhausting slots 151 via the central opening 1 Sa of the cylinder cap 115. In addition, the compressed air supplied to the variable pressure chamber 103 may leak to the outside through the openings 114 via the air ports 108 and the lower piston chamber 111.

Because of such leakage of the compressed air from both the exhausting slots 151 and the openings 114, the upper piston chamber 113 may not be sufficiently pressurized. Therefore, the piston 110 may not return to the initial position (lower stroke end). As a result, the leakage of the compressed air may continue.

In contrast, according to the nailer 1 of the representative embodiment of the present invention, the cylinder 13 is normally biased upward by the compression spring 25. Therefore, even if the supply of the compressed air to the pressure accumulation chamber A or to the variable pressure chamber 23 has been stopped, the cylinder 13 may reliably be held in the upper stroke end by the compression spring 25. Thus, the cylinder cap 17 is pressed against the seal plate 12*a*, so that the upper piston chamber 22 is kept to be disconnected from the outside. For this reason, when the air hose is again connected to the nailer 1 to supply the compressed air to the pressure accumulation chamber A, the air flown into the upper piston chamber 22 may not leak from the central opening 17*a* of the cylinder cap 17 to the outside even if the piston 14 is not positioned at the lower stroke end.

Therefore, the pressure within the upper piston chamber 22 may be sufficiently increased, so that the piston 14 can reliably return to the lower stroke end. As the piston 14 thus returns to the lower stroke end, the variable pressure chamber 23 may be disconnected from the lower piston chamber 24, so that the pressure within the variable pressure chamber 23 increases. By the increased pressure within the variable pressure chamber 23, the sleeve valve 16 is returned to the upper stroke end. In addition, the cylinder 13 is also returned to the lower stroke end against the biasing force of the compression spring 25.

The driving depth adjusting mechanism will now be described with reference to FIG. 12. As previously described, the driving depth adjusting mechanism includes the stopper block 54*a* that is formed on the lateral side of the upper end of the nail guide 54. The stopper block 54*a* extends outwardly through the guide slot 51*a* formed in the support sleeve 51.

A support plate 70 may bc formed on the support sleeve 51 in a position slightly above the upper end of the guide slot 51*a*. The support plate 70 extends laterally from the support sleeve 51 and includes a circular hole 70*a* formed therein. A substantially cylindrical switching member 71 may be rotatably fitted into the circular hole 70*a*.

Five stepped surfaces 71*a* to 71*e* may be formed at the lower end of the switching member 71. The stepped surfaces 71*a* to 71*e* are positioned at different levels from each other. The levels of the stepped surface 71*a* to 71*e* become higher in this sequence. By rotating the switching member 71, any one of the stepped surfaces 71*a* to 71*e* can be selectively positioned just above the stopper block 54*a*. A flange 71*f* is formed on the upper end of the switching member 71 and includes an upright support pin 71*g* extending upward therefrom.

On the other hand, a support base 72 may be formed on the lower side of the housing 11. The support base 72 includes a vertical hole 72*a* that opens at the lower surface of the support base 72. The support pin 71*g* of the switching member 71 is rotatably inserted into the vertical hole 72*a*. The flange 71*f* of the switching member 71 is held between the lower surface of the support base 72 and the support plate 70 of the support sleeve 70, so that the switching member 71 is fixed in position in the vertical direction.

Further, five hemispherical engaging recesses 71*h* may be formed in the upper surface of the flange 71*f*. The engaging recesses 71*h* are equally spaced from each other in the circumferential direction about the support pin 71*g*. An engaging ball 74 may be forced downward against the upper surface of the flange 71*f* by means of a compression spring 73, so that the engaging ball 74 may selectively engage any one of the engaging recesses 7 lh. As a result, the rotational position of the switching member 71 can be selectively determined among five positions, in which any one of the stepped surfaces 71*a* to 71*e* vertically opposes to the stopper block 54*a*.

In order to operate the driving depth adjusting mechanism, the operator rotates the switching member 71 such that selective one of the stepped surfaces 71*a* to 71*e* vertically opposes the stopper block 54*a*. Because the stepped surfaces 71*a* to 71*e* are different in height from each other, the stroke of the nail guide 54 can be changed by selecting one of the stepped surfaces 71*a* to 71*e* that is to be opposed to the stopper block 54*a*. As a result, the lower stroke end of the driver 15 can be adjusted, and therefore, the driving depth of the nail N can be varied.

For example, when the lowest stepped surface 71*a* is positioned to oppose to the stopper block 54*a*, the maximum stroke of the nail guide 54 can be obtained, so that the lower stroke end of the driver 15 comes to a position that is the nearest to the workpiece W, Therefore, the driving depth of the nail N is set to the maximum depth. On the other hand, when the highest stepped surface 71*e* is positioned to oppose to the stopper block 54*a*, the minimum stroke of the nail guide 54 can be obtained. Therefore, the lower stroke end of the driver 15 comes the farthest position to the workpiece W, so that the driving depth of the nail N is set to the minimum depth.

In FIGS. 1 to 10, the driving depth adjusting mechanism is omitted for the illustration purpose.

Figure 15:
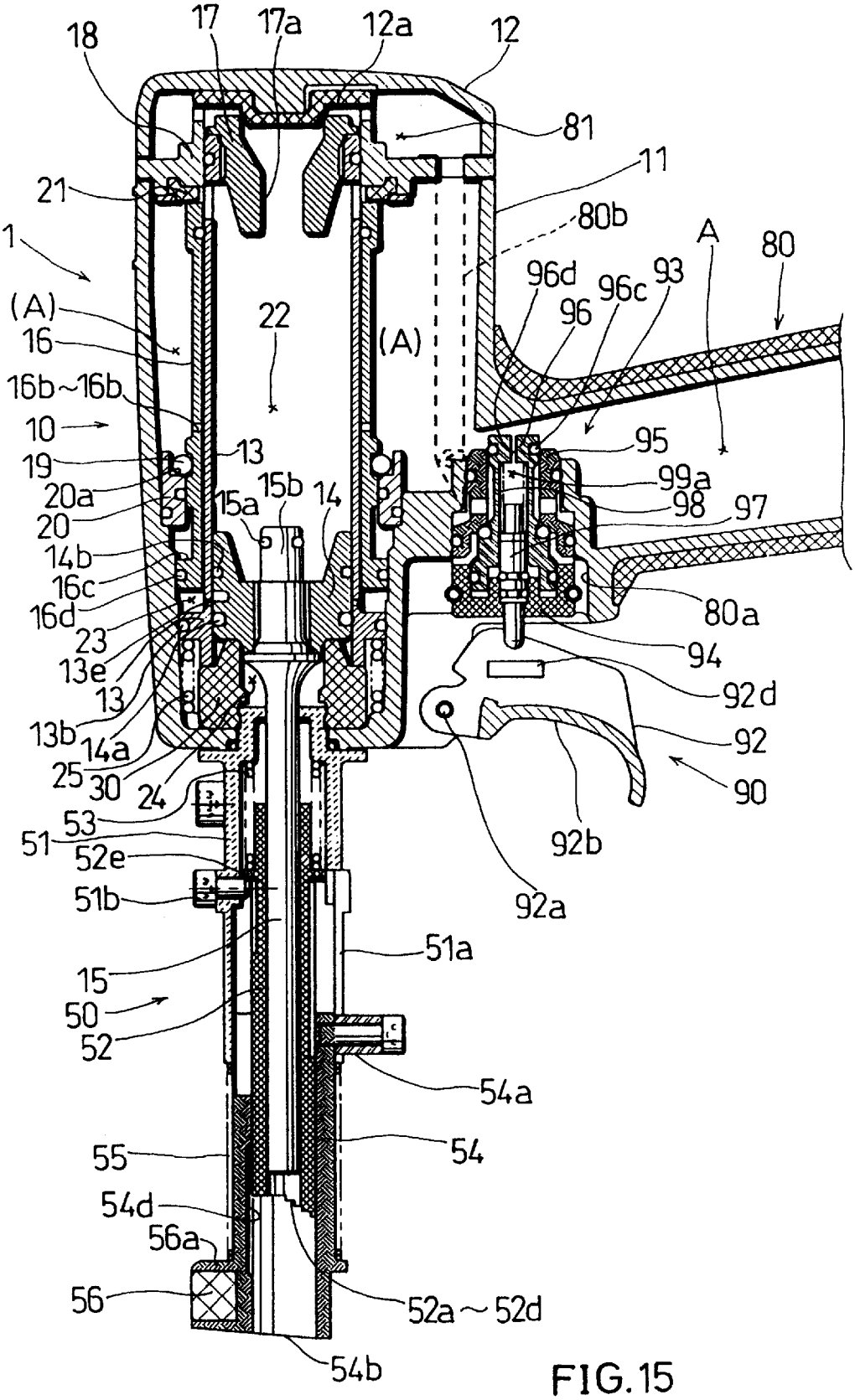
FIG. 15 is a sectional view of the nailer with a safety device according to an alternative embodiment.

An alternative embodiment of the safety device 64 of the above representative embodiment will now be described with reference to FIGS. 15 and 16. A safety device 90 of the alternative embodiment may comprise a trigger 92 that is pivotally mounted on the lower side of the housing 11 by means of a pivot pin 92*a* as in the safety device 64 of the previously described embodiment. The safety device 90 however does not include a contact arm 57 but includes a trigger valve 93.

The trigger 92 may include a protrusion 92*d* that is formed on the rear side of the trigger 92 below the trigger valve 93. Although not shown in the drawings, a compression spring is provided for biasing the trigger 92 in the clockwise direction as viewed in FIGS. 15 and 16. In addition, a stopper (not shown) is provided for limiting the pivotal end (an off-side pivotal end) of the trigger 92.

The trigger valve 93 may be received within a mounting recess 80*a* formed on the lower side of the rear end of the handle 80. The trigger valve 93 may comprise a substantially annular first valve member 94, a tubular second valve member 95, a tubular third valve member 96 and a valve stem 97. The first valve member 94 is secured within the mounting recess 80. The second valve member 94 also is secured within the mounting recess 80 but is disposed upward of the first valve member 94. The third valve member 96 is axially slidably received within the second valve member 95 and has a top closure. The valve stem 97 has an upper end and a rear end that are slidably received within the third valve member 96 and the first valve member 94, respectively, so that the valve stem 97 is slidably movable relative to both the third valve member 96 and the first valve member 94.

A compression spring 98 may be interposed between the upper portion of the valve stem 97 and the top closure of the third valve member 96, so that the valve stem 97 is normally biased downward. As shown in FIG. 16, the valve stem 97 has a head 97*c* on its lower end, which head is positioned right above the protrusion 92*d*. Seal rings 97*a* and 97*b* may be fitted on the valve stem 97.

Three seal rings 96*a*, 96*b* and 96*c* may be fitted on the third valve member 96 at the upper portion, the middle portion and the lower portion thereof, respectively. An air port 96*d* may be formed in the top closure of the third valve member 96, so that an upper stem chamber 99*a* formed inside of the third valve member 96 always communicates with the pressure accumulation chamber A.

A plurality of air ports 95*a* may be formed on the lateral side of the second valve member 95, so that an annular air chamber 99*b* formed between the second valve member 95 and the third valve member 96 always opens at the inner wall of the mounting recess 80*a* via the air ports 95*a*. A communication channel 80*b* is formed in the housing 11. The communication channel 80*b* has one end open at the inner wall of the mounting recess 80*a* and has the other end connected to the exhaust channel 81 of the body 10.

In order to operate the nailer 1, the operator must pull the trigger 92 to open the trigger valve 93 of the safety device 90. FIGS. 15 and 16 show the trigger valve 93 in the close state or the state, in which the trigger 92 has not been pulled.

In the close state of the trigger valve 93, the valve stein 97 is held at the lower stroke end by the biasing force of the compression spring 98, so that the upper seal ring 97*b* is positioned within a lower stem chamber 99*c* formed in the lower portion of the third valve member 96. Therefore, the upper stem chamber 99*a* and the lower stem chamber 99*c* communicates with each other, so that the compressed air is supplied from the pressure accumulation chamber A to the lower stem chamber 99*c* via the upper stem chamber 99*a*. The compressed air thus supplied to the lower stem chamber 99*c* applies a pressure against the third valve member 96 to move upward, so that the middle seal ring 96*b* of the third valve member 96 is pressed against a conical inner surface part of the second valve member 95. Therefore, a result the annular air chamber 99*b* is disconnected from an open channel 99*d* that opens to the outside and that is formed between the lower end of the second valve member 95 and the upper end of the first valve member 94.

Figure 16:
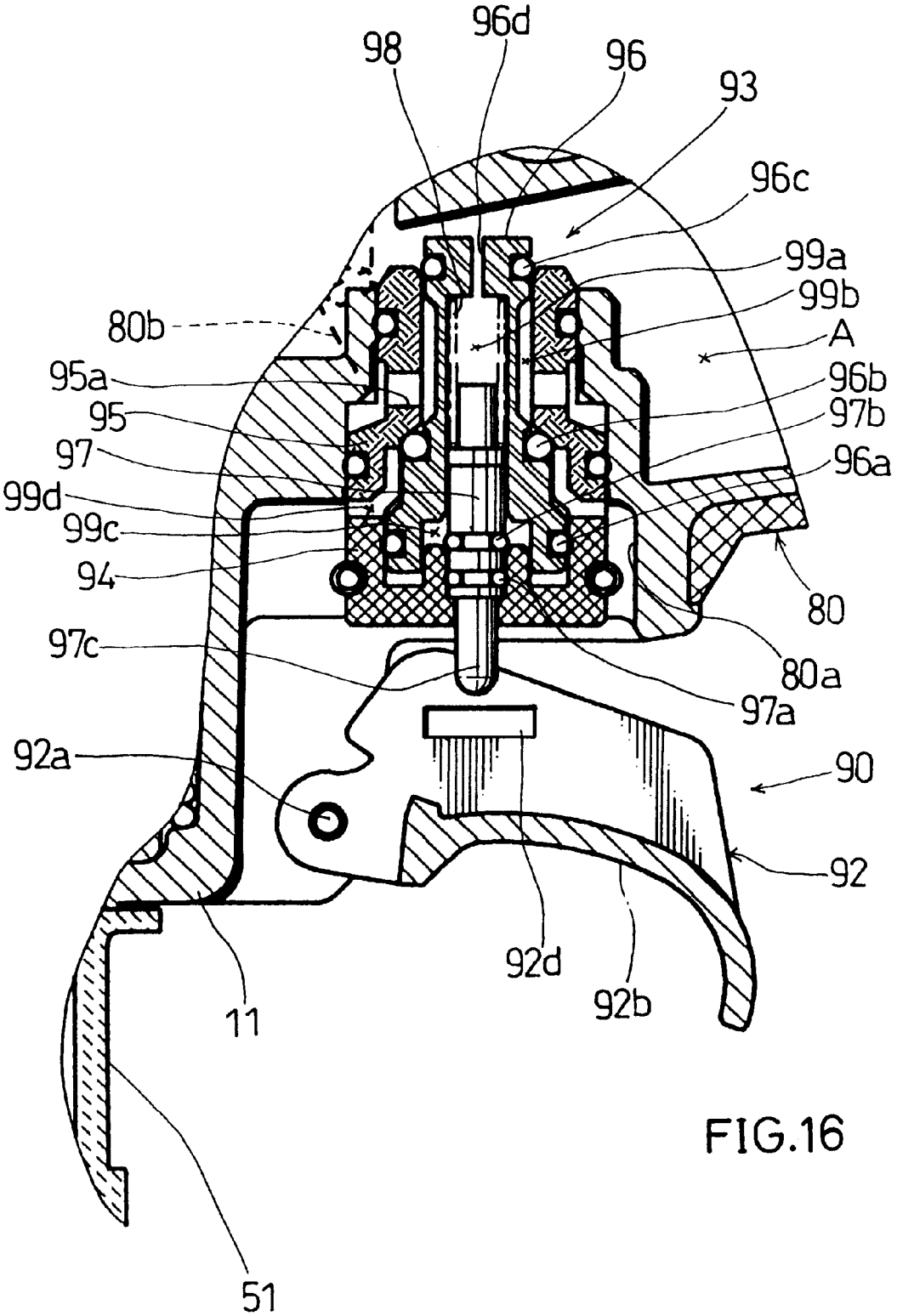
FIG. 16 is an enlarged view of the safety device.

When the third valve member 96 is in the uppermost position shown in FIG. 16, the seal ring 96*c* does not engage the inner surface of the second valve member 95, so that the annular air chamber 99*b* communicates with the pressure accumulation chamber A. The compressed air is therefore supplied to the air chamber 99*b*. As previously described, the air chamber 99*b* always opens at the inner wall of the mounting recess 80*a* via the air ports 95*a*. In addition, the communication channel 80*b* opens at the inner wall of the mounting recess 80*b* on one side and communicates with the exhaust channel 81 of the body 10 on the other side. Therefore, the compressed air is supplied to the exhaust channel 81 and subsequently enters the upper piston chamber 22 to apply the pressure on the piston 14. Because of such pressure applied to the piston 14, the piston 14 may not be moved upward even if the nailer 1 has been pressed against the workpiece W for driving the nail N. As a result, a drive lock state can be obtained.

On the other hand, when the operator pulls the trigger 92 to pivot the same in the counterclockwise direction against the biasing force of the compression spring (not shown), the protrusion 92*d* abuts the head 97*c* of the valve stem 97 so as to lift the valve stem 97 against the biasing force of the compression spring 98. As the valve stem 97 is thus lifted, the upper seal ring 97*b* of the valve stem 97 moves to seal between the valve stem 97 and the third valve member 96, so that the upper stem chamber 99*a* is disconnected from the lower stem chamber 99*c*. In addition, the lower seal ring 97*a* moves to be disengaged from the first valve member 94, so that the lower stem chamber 99*c* opens to the outside.

Because the lower stem chamber 99*c* is disconnected from the pressure accumulation chamber A and opens to outside, the pressure of the pressure accumulation chamber A applied to the upper end of the third valve member 96 forces the third valve member 96 to move downward. Therefore, the upper seal ring 96*c* of the third valve member 96 moves to seal between the second valve member 95 and the third valve member 96, so that the annular air chamber 99*b* is disconnected from the pressure accumulation chamber A. In addition, the middle seal ring 96*b* is moved apart from the conical inner surface part of the second valve member 95, so that the air chamber 99 opens to the outside via the open channel 99*d*.

Because the open channel 99*d* communicates with the upper piston chamber 81 via the air ports 95*a*, the communication channel 80*b* and the exhaust channel 81, the upper piston chamber 81 opens to the outside. Thus, the piston 14 can be moved upward to start the nail driving operation.

As described above, by pulling the trigger 92, the trigger valve 93 is opened to provide a lock releasing stale. The nailer 1 cannot be operated to drive nails as long as the trigger 92 is not pulled, so that an accidental driving operation of the nailer 1 can be reliably prevented.

Incidentally, in the representative embodiment described above, the magnet 56 is mounted on the lower end of the nail guide 54 for holding the nail N in position. As shown in FIG. 15, the magnet 56 may be forcibly fitted into a horizontal cylindrical wall 56*a* that is formed on the lateral side of the lower end of the nail guide 54. Thus, with this mounting structure of the magnet 56, the magnet 56 does not directly contact the nail N but attracts the nail N with the intervention of the bottom of the cylindrical recess 56*a* that is a part of the nail guide 54. The nail guide 54 may be normally made of a carbon steel or a magnetic material. Therefore, the magnetic flux of the magnet 56 may be influenced by the nail guide 54, so that the attracting force of the magnet 56 may be weakened.

On the other hand, if the magnet 56 is directly exposed to the inside of the nail guide 54, the magnet 56 may be damaged when an impact is applied from the nail N to the magnet 56 due to the interference of the head of the nail N with the driver 15. Therefore, the durability of the magnet 56 may be remarkably degraded.

In order to improve this problem, Japanese Utility Model Publication No. 6-5093 teaches the use of a high manganese steel as a material of a nail guide, to which a magnet is attached in the same manner as the above preferred embodiment. Because the high manganese steel is a non-magnetic material, the magnetic flux of a magnet may not be influenced by the nail guide. Therefore, a sufficient attracting force can be provided without causing any damage on the magnet. However, because the high manganese steel is a costly material, the manufacturing cost of the driver guide may increase.

An alternative embodiment of the magnet mounting structure will now be described with reference to FIGS. 17 and 18. This alternative embodiment may ensure a strong attracting force by a magnet while any damage on the magnet can be prevented.

Figure 17:
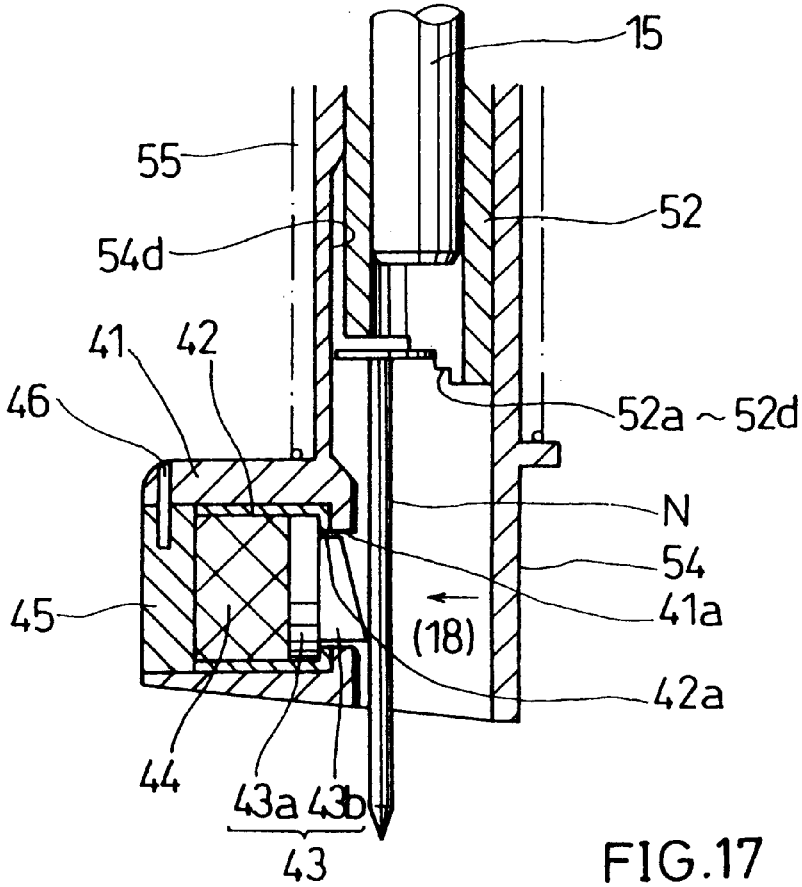
FIG. 17 is a sectional view of the nail guide of the nailer with a magnet mounting structure according to an alternative embodiment.
Figure 18:
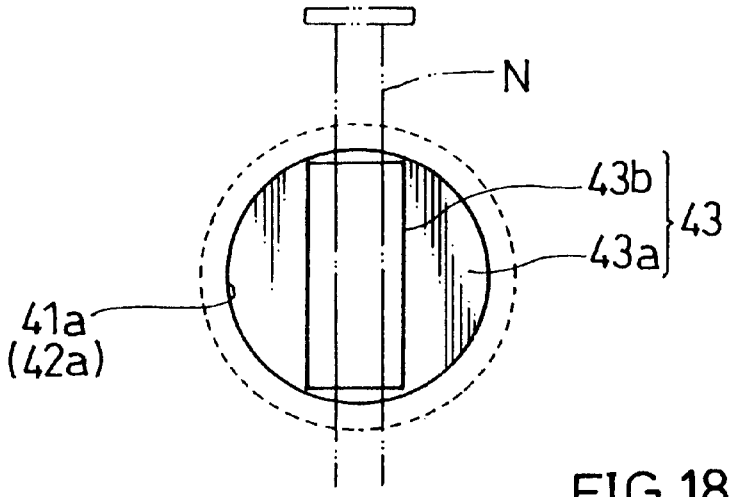
FIG. 18 is a side view of a contact block of the alternative embodiment shown in FIG. 17 as viewed in a direction of arrow (18) in FIG. 17.

As shown in FIG. 17, a horizontal cylindrical wall 41 may be formed on the lateral side of the lower end of the nail guide 54. The nail guide 54 including the cylindrical wall 41 is made of a carbon steel or a magnetic material. The right side end or the bottom of the cylindrical wall 41 includes an opening 54, so that the interior of the cylindrical wall 41 communicates with the inside of the nail guide 54. The bottom of the cylindrical wall 41 having the opening 41*a* has a collar-like configuration or an annular configuration and extends inwardly of the cylindrical wall 41 to some extent. A cap 42 made of synthetic resin may be fitted into the cylindrical wall 41, so that a synthetic resin layer can formed inside of the cylindrical wall 41. The bottom of the cap 42 has an opening 42*a* that has the same size as the opening 41*a* of the cylindrical wall 41.

A contact block 43 and a magnet 44 (a permanent magnet) may be fitted within the cap 42. Preferably, the contact block 43 is made of a magnetic steel, such as a chrome molybdenum steel (SCM 435). The contact block 43 includes a disk-like portion 43*a* and a protrusion 43*b*. As shown in FIG. 18, the protrusion 43*b* has a block-like configuration that has a longitudinal axis extending along a diameter of the disk-like portion 43*a*. In addition, the protrusion 43*b* has a width that is greater than the width of a shank of a nail N to be driven. The contact block 43 may be bonded to the magnet 44 such that the longitudinal axis of the protrusion 43*b* extends in the vertical direction.

As shown in FIG. 17, the protrusion 43*b* has a front surface that is inclined downward in the right direction. Thus, substantially the lower half portion of the protrusion 43*b* partly extends into the nail guide 54 through the openings 42*a* and 41*a*.

The magnet 44 may be bonded to the inner surface of the cap 42. The magnet 44 has a cylindrical configuration that has the same diameter as the disk-like portion 43*a* of the contact block 43. The magnet 44 also is bonded to the disk-like portion 43*a* such that there exists no clearance between the magnet 44 and the disk-like portion 43*a*.

A lid 45 may be fitted into the cylindrical wall 41 to contact the magnet 44 as well as the cap 42. A pin 45 may be forcibly inserted into the lid 45 through the cylindrical wall 41, so that the lid 45 can be fixed in position relative to the cylindrical wall 41. Therefore, the cap 42, the contact block 43 and the magnet 44 can be reliably fixed in position relative to the cylindrical wall 41.

According to this alternative embodiment of the magnet mounting structure, the magnet 44 directly contacts the contact block 43 that is made of a magnetic material, so that the contact block 43 may be magnetized by the magnet 44. Because the contact block 43 thus magnetized contacts the nail N, the magnetic force of the magnet 44 can be effectively utilized to attract the nail N. In addition, because the nail N does not directly contact the magnet 44, the magnet 44 may not be damaged. Further, if a chrome molybdenum steel is selected as a material of the contact block 43, the hardness or the stiffness of the contact block 43 can be improved by suitably treating with heat. Therefore, the durability of the nailer 1 can be improved.

Furthermore, because the magnet 44 is surrounded by the cap 42 made of synthetic resin, a magnetic force of the magnet 44 can be effectively influenced on the contact block 43. Therefore, the attracting force applied to the nail N can be further improved.

More importantly, the nail guide 54 may be made of a usual non-expensive material, such as a carbon steel, and is not required to be made of an expensive material, such as a high manganese steel. Therefore, the manufacturing cost may not be increased.

What is claimed is:

1. A pneumatic tool comprising:

a housing;

a cylinder disposed within said housing;

a piston slidably movable within said cylinder, said piston having a driver for driving fasteners, such as nails;

an upper piston chamber and a lower piston chamber defined within said cylinder on an upper side and a lower side of said piston, respectively;

compressed air supply means;

control means for controlling the supply of the compressed air from said compressed air supply means to said upper piston chamber and to said lower piston chamber to drive the fasteners into a workpiece;

said control means including a variable pressure chamber and valve means, said variable pressure chamber being always connected to said compressed air supply means, and said valve means being operable to connect and disconnect said variable pressure chamber and said lower piston chamber in response to the position of said piston relative to said cylinder; and means for maintaining a predetermined volume in said variable pressure chamber, irrespective of the operation of said control means.

2. The pneumatic tool as defined in claim 1, wherein said control means further includes a sleeve valve for controlling the supply of the compressed air front said compressed air supply means to said upper piston chamber, and wherein said variable pressure chamber is defined between said cylinder and said sleeve valve.

3. The pneumatic tool as defined in claim 2, wherein said cylinder and said sleeve valve are movable relative to said housing independently of each other, and wherein the volume of said variable piston chamber varies with changes in position of said sleeve valve relative to said cylinder.

4. The pneumatic tool as defined in claim 2 wherein said means for maintaining the volume of said variable pressure chamber comprises stopper means for limiting a lower stroke end of said sleeve valve.

5. The pneumatic tool as defined in claim 4, wherein said stopper means includes a seal ring mounted on said sleeve valve and a stopper block mounted within said housing, said stopper block having an abutting surface, to which said seal ring abuts.

6. The pneumatic tool as defined in claim 1, wherein said control means further includes second valve means for connecting and disconnecting between said upper piston chamber and the outside of the tool;

said second valve means including a cylinder cap and a protrusion, said cylinder cap being mounted on an upper end of said cylinder and having an exhaust hole formed therein for communication with the outside, said protrusion being formed on said piston and having a seal ring mounted thereon, and said protrusion extending into said upper piston chamber, so that said exhaust hole can be closed by said seal ring of said protrusion when said piston with said protrusion moves upward.

7. The pneumatic tool as defined in claim 3, wherein said cylinder has an upper stroke end and a lower stroke end, said cylinder being operable to disconnect said upper piston chamber from the outside when said cylinder is in said upper stroke end, and wherein means is provided for normally biasing said cylinder in a direction toward said upper stroke end.

8. The pneumatic tool as defined in claim 1 further including a driver guide, a contact arm and a trigger;

said driver guide being vertically movably mounted on a lower portion of said housing, said contact arm being movable with said driver guide, said trigger being operable by an operator between a first position and a second position;

said trigger in said first position permitting said contact arm to move upward from a lower stroke end for enabling the driving operation of the nails, and said trigger in said second position preventing said contact arm from moving upward from said lower stroke end.

9. The pneumatic tool as defined in claim 8, wherein said trigger includes a stopper;

said stopper being in a opposing position to an upper end of said contact arm so as to prevent said contact arm from moving upward from said lower stroke end when said trigger is in said second position; and said stopper being retracted from said opposing position to permit the upward movement of the contact arm from said lower stroke end as said trigger is moved from said second position to said first position.

10. The pneumatic tool as defined in claim 1 further comprising a fastener guide and driving depth adjusting means;

said fastener guide being vertically movably mounted on a lower portion of said housing; and said driving depth adjusting means being operable to change an upper stroke end of said fastener guide.

11. The pneumatic tool as defined in claim 10, wherein said driving depth adjusting means includes a stopper block mounted on said fastener guide and includes a switching member mounted on said housing and vertically opposing to said stopper block;

said switching member including a plurality of stepped surfaces that extend at different levels from each other; and said switching member being operable by an operator so that any one of said stepped surfaces can selectively positioned to oppose to said stopper block.

12. A pneumatic tool comprising:

a housing;

a cylinder disposed within said housing;

a piston slidably movable within said cylinder, said piston having a fastener driver;

an upper piston chamber and a lower piston chamber defined within said cylinder on an upper side and a lower side of said piston, respectively;

a compressed air supply;

a compressed air supply controller coupled to said compressed air supply, to said upper piston chamber and to said lower piston chamber, comprising:

a variable pressure chamber and a valve, said variable pressure chamber being connected to said compressed air supply, and said valve being operable to connect and disconnect said variable pressure chamber and said lower piston chamber in response to the position of said piston relative to said cylinder; and said variable pressure chamber maintaining a predetermined volume, irrespective of the operation of said compressed air supply controller.

* * * * *